US008450036B2

(12) United States Patent
Yamamoto

(10) Patent No.: US 8,450,036 B2
(45) Date of Patent: May 28, 2013

(54) ELECTROPHOTOGRAPHIC PHOTORECEPTOR, IMAGE FORMING APPARATUS, AND PROCESS CARTRIDGE

(75) Inventor: Shinya Yamamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 114 days.

(21) Appl. No.: 13/247,531

(22) Filed: Sep. 28, 2011

(65) Prior Publication Data

US 2012/0251933 A1 Oct. 4, 2012

(30) Foreign Application Priority Data

Mar. 28, 2011 (JP) ..... 2011-071189

(51) Int. Cl.
*G03G 5/00* (2006.01)

(52) U.S. Cl.
USPC ..... 430/66; 399/159

(58) Field of Classification Search
USPC ..... 430/66; 399/159
See application file for complete search history.

(56) References Cited

U.S. PATENT DOCUMENTS

| | | | |
|---|---|---|---|
| 4,792,507 | A | 12/1988 | Yoshihara et al. |
| 6,677,091 | B2 | 1/2004 | Niimi |
| 2002/0119382 | A1 | 8/2002 | Nakata et al. |
| 2003/0104295 | A1 | 6/2003 | Niimi |

FOREIGN PATENT DOCUMENTS

| | | |
|---|---|---|
| JP | A-56-051749 | 5/1981 |
| JP | A-63-221355 | 9/1988 |
| JP | B2-02-007057 | 2/1990 |
| JP | A-04-012365 | 1/1992 |
| JP | A-04-189873 | 7/1992 |
| JP | A-04-324451 | 11/1992 |
| JP | A-04-345167 | 12/1992 |
| JP | A-05-043823 | 2/1993 |
| JP | A-05-098181 | 4/1993 |
| JP | A-05-140472 | 6/1993 |
| JP | A-05-140473 | 6/1993 |
| JP | A-05-263007 | 10/1993 |
| JP | A-05-279591 | 10/1993 |
| JP | A-08-176293 | 7/1996 |
| JP | A-08-208820 | 8/1996 |
| JP | A-08-278645 | 10/1996 |
| JP | B2-2675035 | 7/1997 |
| JP | A-2002-082469 | 3/2002 |
| JP | A-2003-186234 | 7/2003 |
| JP | B2-3773868 | 2/2006 |
| JP | B2-3831672 | 10/2006 |
| JP | A-2009-145480 | 7/2009 |

*Primary Examiner* — Mark A Chapman
(74) *Attorney, Agent, or Firm* — Oliff & Berridge, PLC

(57) ABSTRACT

An electrophotographic photoreceptor containing fluororesin particles in which the cross-section obtained by cutting a surface layer along the thickness direction satisfies the following (1) and (2):

$$0 \leqq A_1 \leqq 0.5 \times A_2 \quad (1):$$

$$0.7 \times A_3 \leqq A_2 \leqq 1.2 \times A_3 \quad (2):$$

wherein $A_1$ represents the proportion (%) of the area of the fluororesin particles occupying a region designated as a first region; $A_2$ represents the proportion (%) of the area of the fluororesin particles occupying a region designated as a second region; and $A_3$ represents the proportion (%) of the area of the fluororesin particles occupying the entire cross-section with respect to the entire area of the cross-section.

17 Claims, 5 Drawing Sheets

ELECTROPHOTOGRAPHIC PHOTORECEPTOR, IMAGE FORMING APPARATUS, AND PROCESS CARTRIDGE

CROSS-REFERENCE TO RELATED APPLICATIONS

This application is based on and claims priority under 35 USC 119 from Japanese Patent Application No. 2011-071189 filed Mar. 28, 2011.

BACKGROUND

Technical Field

The present invention relates to an electrophotographic photoreceptor, an image forming apparatus, and a process cartridge.

SUMMARY

According to an aspect of the invention, there is provided an electrophotographic photoreceptor including:

a substrate;

a photosensitive layer provided on the substrate; and a surface layer that is a single layer provided on the photosensitive layer to be in contact with the photosensitive layer, contains fluororesin particles, and has a thickness of 4 μm or greater, in which the cross-section obtained when the surface layer is cut along the thickness direction satisfies the following formula (1) and the following formula (2):

$$0 \leqq A_1 \leqq 0.5 \times A_2 \quad \text{Formula (1):}$$

$$0.7 \times A_3 \leqq A_2 \leqq 1.2 \times A_3 \quad \text{Formula (2):}$$

wherein in the formula (1) and the formula (2), $A_1$ represents the proportion (%) of the area of the fluororesin particles occupying a region designated as a first region, which lies in the cross-section at a distance from the interface between the photosensitive layer and the surface layer, of from 0 μm to 0.5 μm; $A_2$ represents the proportion (%) of the area of the fluororesin particles occupying a region designated as a second region, which lies in the cross-section at a distance from the interface between the photosensitive layer and the surface layer, of from 1 μm to 3 μm; and $A_3$ represents the proportion (%) of the area of the fluororesin particles occupying the entire cross-section with respect to the entire area of the cross-section.

BRIEF DESCRIPTION OF THE DRAWINGS

Exemplary embodiments of the present invention will be described in detail based on the following figures, wherein.

DETAILED DESCRIPTION

Figure 1:
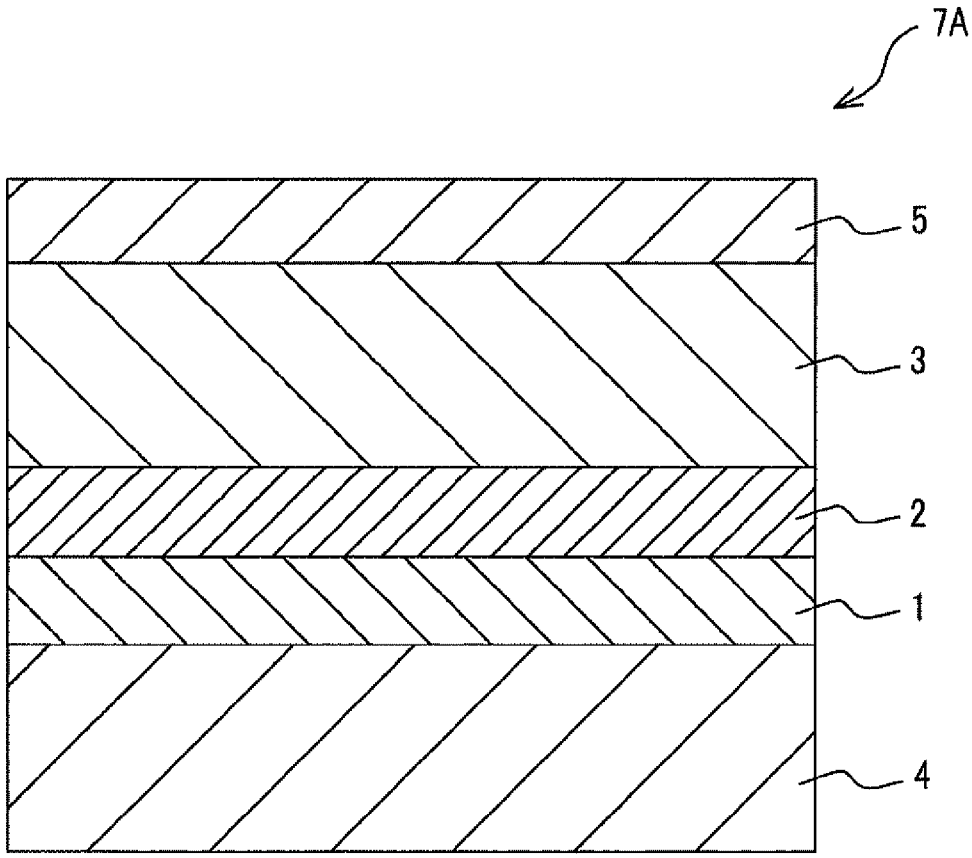
FIG. 1 is a schematic partial cross-sectional diagram showing the electrophotographic photoreceptor according to a first exemplary embodiment of the invention.

Hereinafter, the exemplary embodiment of the invention will be described in detail.

<Electrophotographic Photoreceptor>

The electrophotographic photoreceptor (hereinafter, may be simply referred to as "photoreceptor") according to the exemplary embodiment of the invention has a substrate, a photosensitive layer provided on the substrate, and a surface layer provided on the photosensitive layer to be in contact with the photosensitive layer. The surface layer is a single layer having a thickness of 4 μm or greater, and contains fluororesin particles, and when the surface layer is cut along the thickness direction, the cross-section satisfies the following formula (1) and the following formula (2):

$$0 \leqq A_1 \leqq 0.5 \times A_2 \quad \text{Formula (1):}$$

$$0.7 \times A_3 \leqq A_2 \leqq 1.2 \times A_3 \quad \text{Formula (2):}$$

Here, in the formula (1) and the formula (2), $A_1$ represents the proportion (%) of the area of the fluororesin particles occupying a region designated as a first region, which lies in the cross-section at a distance from the interface between the photosensitive layer and the surface layer, of from 0 μm to 0.5 μm; $A_2$ represents the proportion (%) of the area of the fluororesin particles occupying a region designated as a second region, which lies in the cross-section at a distance from the interface of from 1 μm to 3 μm; and $A_3$ represents the proportion (%) of the area of the fluororesin particles occupying the entire cross-section with respect to the entire area of the cross-section.

In regard to the method of determining the values of $A_1$, $A_2$ and $A_3$, a cross-sectional SEM image of the surface layer is obtained by, for example, first cutting the surface layer of the photoreceptor with a knife or the like along the thickness direction, treating the exposed cut surface with a microtome, and observing the cross-section in the thickness direction of the surface layer (hereinafter, may be simply referred to as "cross-section of the surface layer") with a scanning electron microscope (SEM). As the scanning electron microscope, for example, JSM-6700F/JED-2300F (manufactured by JEOL, Ltd.) is used.

In the cross-sectional SEM image thus obtained, the area of the cross-section in which the fluororesin particles are cut and exposed (that is, the area occupied by the fluororesin particles) is calculated, and the proportion (%) of the area occupied by the fluororesin particles with respect to the area of the entire cross-section of the surface layer is determined. This value is designated as $A_3$.

Similarly, in a region (first region) which lies at a distance of from 0 μm to 0.5 μm from the edge that is in contact with the photosensitive layer (that is, the interface between the photosensitive layer and the surface layer) in the cross-section of the surface layer, the proportion (%) of the area occupied by the fluororesin particles with respect to the area of the entire cross-section of the surface layer is determined, and the value is designated as $A_1$.

Furthermore, in a region (second region) which lies at a distance of from 1 μm to 3 μm from the edge that is in contact with the photosensitive layer (that is, the interface between the photosensitive layer and the surface layer) in the cross-section of the surface layer, the proportion (%) of the area occupied by the fluororesin particles with respect to the area of the entire cross-section of the surface layer is determined, and the value is designated as $A_2$.

When the photoreceptor of the exemplary embodiment of the invention has the configuration as described above, the removability of the toner that remains on the surface of the electrophotographic photoreceptor is maintained, as compared with the case where the cross-section in the thickness direction of the surface layer does not satisfy the formula (1) or the formula (2). The reason for this is not clearly understood, but the reason is speculated to be as follows.

First, it is thought that a photoreceptor in which the surface layer contains fluororesin particles as in the exemplary embodiment of the invention, has reduced surface energy at the surface of the photoreceptor as compared with the case where the surface layer does not contain fluororesin particles, and thus the releasability of the toner remaining on the surface of the photoreceptor is excellent (that is, satisfactory removability of residual toner).

However, the surface layer of the photoreceptor wears out as the photoreceptor is used, and the surface layer is thinned. Therefore, for example, when the fluororesin particles are localized only at the surface side of the photoreceptor (that is, a region close to the surface opposite to the face that is in contact with the photosensitive layer in the surface layer), it is thought that as a result of the usage of the photoreceptor, the region in the surface layer in which the fluororesin particles are localized will be removed by wearing. Also, in this case, since the amount of the fluororesin particles present in the interior of the surface layer is relatively small, for example, if the photoreceptor is used until the thickness of the remaining surface layer (hereinafter, may be referred to as "residual thickness") reaches 3 μm or less, it is thought that a region with a smaller amount of the fluororesin particles will be exposed to the surface. Thereby, it is thought that the effect of lowering the surface energy due to the fluororesin particles is not easily obtained, and it is difficult to maintain the removability of residual toner.

For example, it may be conceived to incorporate the fluororesin particles uniformly over the entire surface layer, in order to maintain the effect of lowering the surface energy due to the fluororesin particles. However, in regard to this embodiment, a large amount of the fluororesin particles is present even in a region on the surface side that is in contact with the photosensitive layer in the surface layer (that is, a region which lies at a distance of from 0 μm to 0.5 μm from the interface with the photosensitive layer). Therefore, it is thought that the surface energy is reduced not only at the surface of the photoreceptor, but also at the face that is in contact with the photosensitive layer in the surface layer, so that the surface layer is easily peeled from the photosensitive layer. It is also thought that, for example, at the time of forming an image, when the photoreceptor rotates while another member such as a toner removal unit is in contact with the surface of the photoreceptor, the surface layer is peeled off from the photosensitive layer so that the removal of the residual toner is made difficult, and image defects such as image deletion occur.

On the contrary, in the exemplary embodiment of the invention, the cross-section of the surface layer satisfies the formula (1) and the formula (2) as described above.

That is, according to the exemplary embodiment of the invention, it is thought that the amount of the fluororesin particles that are present in the region on the interface side with the photosensitive layer (that is, the region which lies at a distance of from 0 μm to 0.5 μm from the interface with the photosensitive layer) is small, and the peeling of the surface layer is suppressed, as compared with the case where the formula (1) is not satisfied.

Furthermore, in the exemplary embodiment of the invention, it is thought that the amount of the fluororesin particles present in the region which lies at a distance of from 1 μm to 3 μm from the interface with the photosensitive layer, acquires a value close to the average of the content of the fluororesin particles in the entire surface layer, as compared with the case where the formula (2) is not satisfied. Therefore, it is thought that the effect of lowering the surface energy due to the fluororesin particles is maintained even if the residual thickness becomes 3 μm or less as a result of the wear of the surface layer, as compared with the case where, for example, the fluororesin particles are localized only at the surface side of the photoreceptor, and the value of $A_2$ is smaller than 0.7 time the value of $A_3$. Also, it is thought that the removability of residual toner in the beginning is satisfactory, as compared with the case where, for example, the value of $A_2$ is larger than 1.2 times the value of $A_3$, and the amount of the fluororesin particles in the region which lies at a distance of 3 μm or greater from the interface with the photosensitive layer is small.

As discussed above, in the exemplary embodiment of the invention, it is speculated that removability of the toner remaining on the surface of the photoreceptor is maintained, and satisfactory images are formed over a long time period, as compared with the case where the formula (1) or the formula (2) is not satisfied.

Furthermore, it is thought that when the residual thickness of the surface layer is 0.5 μm or less, peeling of the surface layer easily occurs, irrespective of the characteristics of the surface layer (for example, even if the strength of the surface layer is high), and it is difficult to use the photoreceptor. Therefore, use of the photoreceptor until the residual thickness of the surface layer reaches 0.5 μm is not contemplated.

In the exemplary embodiment of the invention, the surface layer is a single layer as described above. Therefore, it is thought that peeling which may occur in the case where, for example, the surface layer is composed of two or more layers containing fluororesin particles, that is, peeling which accompanies the decrease in the surface energy attributable to the fluororesin particles at the interfaces of the respective layers constituting the surface layer (that is, for example, in the case where the surface layer is composed of two layers, the interface between one layer and the other layer), does not occur.

Since the photoreceptor of the exemplary embodiment of the invention maintains the removability of the toner remaining on the surface of the photoreceptor as described above, it is thought that when the photoreceptor is applied to a process cartridge or an image forming apparatus, image defects (for example, stripe-like image density unevenness) caused by a decrease in the removability of residual toner are suppressed as compared with the case of applying a photoreceptor which does not satisfy the formula (1) or the formula (2), and images having excellent image quality are formed for a long time.

According to the exemplary embodiment of the invention, in addition to the fact that the cross-section of the surface layer satisfies the formula (1) and the formula (2), the content of the fluororesin particles in the entire surface layer may have a value close to the average even in a region which lies at a distance of 3 μm or greater from the interface with the photosensitive layer.

Specifically, for example, when the surface layer is a single layer having a thickness of 8 μm or greater, the cross-section of the surface layer may satisfy the following formula (3) in addition to the formula (1) and the formula (2).

$$0.7\times A_3 \leqq A_4 \leqq 1.2\times A_6 \qquad \text{Formula (3):}$$

Here, in the formula (3), $A_4$ represents the proportion (%) of the area of the fluororesin particles occupying a region designated as a third region, which lies in the cross-section of the surface layer at a distance of 4 μm or greater from the interface with the photosensitive layer, and $A_4$ is determined by the same method as in the case of $A_1$ and the like. In addition, $A_3$ is equal to $A_3$ in the formula (2).

Further, when the surface layer has a thickness of 12 μm or greater, $A_4$ in the formula (3) represents the proportion (%) of the area of the fluororesin particles occupying a region designated as a third region, which lies in the cross-section of the surface layer at a distance of 7 μm or greater from the surface of the photoreceptor.

In the embodiment described above, the removability of residual toner is excellent even when the residual thickness of the surface layer is 4 μm or greater, as compared with the case where the formula (3) is not satisfied.

Furthermore, according to the exemplary embodiment of the invention, the value of $A_1$ is 0.5 time the value of $A_2$ or less, but the value of $A_1$ may be 0.3 time or less, or may be 0.1 time or less.

According to the exemplary embodiment, the value of $A_2$ is from 0.7 time to 1.2 times the value of $A_3$, but the value of $A_2$ may be from 0.9 time to 1.1 times, or may be from 1.0 times to 1.1 times.

The value of $A_4$ may be from 0.7 time to 1.2 times the value of $A_3$ as described above, but may be from 0.9 time to 1.1 times, or may be from 1.0 times to 1.1 times.

According to the exemplary embodiment of the invention, the surface layer of which the cross-section satisfies the formula (1) and the formula (2) may be, for example, a surface layer containing the cross-linked product of a mixture containing a cross-linkable compound having an alkoxy group (hereinafter, may be referred to as an "alkoxy compound") and a cross-linkable compound having a hydroxyl group (hereinafter, may be referred to as a "hydroxy compound").

Furthermore, as a method for producing a photoreceptor in which the cross-section of the surface layer satisfies the formula (1) and the formula (2), for example, a method for producing a photoreceptor, including a step of preparing a laminate having a photosensitive layer provided on a substrate, a step of preparing a coating liquid for surface layer containing fluororesin particles, an alkoxy compound and a hydroxy compound, a step of applying the coating liquid for surface layer on the outer peripheral surface of the laminate, and a step of curing the coating liquid for surface layer applied on the outer periphery of the laminate to form a surface layer.

Here, the alkoxy compound may be, for example, a compound having two or more alkoxy groups, and the hydroxy compound may be, for example, a compound having two or more hydroxyl groups.

As discussed above, when an alkoxy compound and a hydroxy compound are used, a photoreceptor in which the cross-section of the surface layer satisfies the formula (1) and the formula (2), and as a result, the photoreceptor, in which the removability of residual toner at the surface thereof is maintained, is obtained. Although the reason is not clearly understood, the reason is speculated to be as follows.

For example, it is thought that when the surface layer is formed by using a coating liquid for surface layer which contains only one kind of a cross-linkable compound and has fluororesin particles dispersed therein, a surface layer in which fluororesin particles are dispersed uniformly from the face that is in contact with the photosensitive layer toward the surface of the photoreceptor is formed. In that case, it is believed that the cross-section of the surface layer satisfies the formula (2), but it is thought that the fluororesin particles are present uniformly even in the region on the interface side with the photosensitive layer, and the cross-section does not satisfy the formula (1).

On the contrary, when two or more kinds of cross-linkable compounds are used as described above (that is, when an alkoxy compound and a hydroxy compound are used), it is thought that the two compounds cause cross-linking reactions at different rates during the process in which the coating liquid for surface layer is cured. Specifically, it is thought that the hydroxy compound undergoes a cross-linking reaction at a relatively faster rate than the alkoxy compound.

The coating liquid for surface layer being applied on the outer peripheral surface of the laminate begins to cure from the surface (the face which is in contact with external air), and both the hydroxy compound and the alkoxy compound react. However, since the alkoxy compound which has a relatively slower rate remains unreacted, it is thought that uncured alkoxy compound are extruded toward the photosensitive layer. At this time, the fluororesin particles that are present in an already cured region are fixed in a cured film where the cross-linkable compound is cured, and therefore, only the alkoxy compound is extruded toward the photosensitive layer. As a result, it is thought that the concentration of uncured alkoxy compound is relatively high in the region on the side of the face that is in contact with the photosensitive layer, while a layer where the concentration of the fluororesin particles is relatively low (hereinafter, may be referred to as "alkoxy layer") is formed. It is speculated that as the alkoxy layer is also finally cured, a surface layer which satisfies both the formula (1) and the formula (2) is formed.

As discussed above, when a coating liquid for surface layer containing fluororesin particles, an alkoxy compound and a hydroxy compound is used, a surface layer which satisfies both the formula (1) and the formula (2) is formed. Furthermore, it is thought that when the method described above (that is, the method for producing the photoreceptor using an alkoxy compound and a hydroxy compound is used), the fluororesin particles are present in a uniformly dispersed state in the region other than the alkoxy layer. Accordingly, it is thought that the formula (1) and the formula (2) are both satisfied, and also, the content of the fluororesin particles in the entire surface layer has a value close to the average (that is, a value equivalent to from 0.7 time to 1.2 times the value of $A_3$), even in the region which lies at a distance of 3 μm or greater from the interface with the photosensitive layer.

When the values of $A_1$ and $A_2$ are finely adjusted, after the alkoxy compound and the hydroxy compound are used, the type of the solvent used in the coating liquid for surface layer (in the case of mixing two or more kinds of solvents, the mixing ratio), the type and amount of addition of the dispersion aid contained in the coating liquid for surface layer (specifically, the fluoroalkyl group-containing copolymer that will be described below, or the like), and the like may also be adjusted.

The details of the alkoxy compound, the hydroxy compound, the solvent, and the dispersion aid will be described below.

(Layer Configuration of Photoreceptor)

The layer configuration of the photoreceptor will be described below.

The photoreceptor of the exemplary embodiment has at least a substrate, a photosensitive layer and a surface layer. There are no particular limitations as long as the surface layer is provided in contact with the photosensitive layer, and for example, the photosensitive layer may be composed of plural layers, and may further have other layers such as an undercoat layer at the position interposed between the substrate and the photosensitive layer.

The configuration of the photoreceptor according to the exemplary embodiment will be described below with reference to FIG. 1 to FIG. 3, but the exemplary embodiment is not intended to be limited to the matter shown in FIG. 1 to FIG. 3.

FIG. 1 is a schematic cross-sectional diagram showing a suitable exemplary embodiment of the electrophotographic photoreceptor according to the exemplary embodiment. FIG. 2 and FIG. 3 are schematic cross-sectional diagrams respectively showing electrophotographic photoreceptors of other exemplary embodiments.

The electrophotographic photoreceptor 7A shown in FIG. 1 is a so-called functionally separated type photoreceptor (or laminated type photoreceptor), and has a structure in which an undercoat layer 1 is provided on a substrate 4, and a photosensitive layer having a charge generating layer 2 and a charge transport layer 3 sequentially formed is provided on the undercoat layer 1, with a protective layer 5 being provided on the photosensitive layer (first embodiment). Also, in the electrophotographic photoreceptor 7A shown in FIG. 1, the substrate 4 corresponds to the substrate described above, the photosensitive layer composed of the charge generating layer 2 and the charge transport layer 3 corresponds to the photosensitive layer described above, and the protective layer 5 corresponds to the surface layer.

Figure 2:
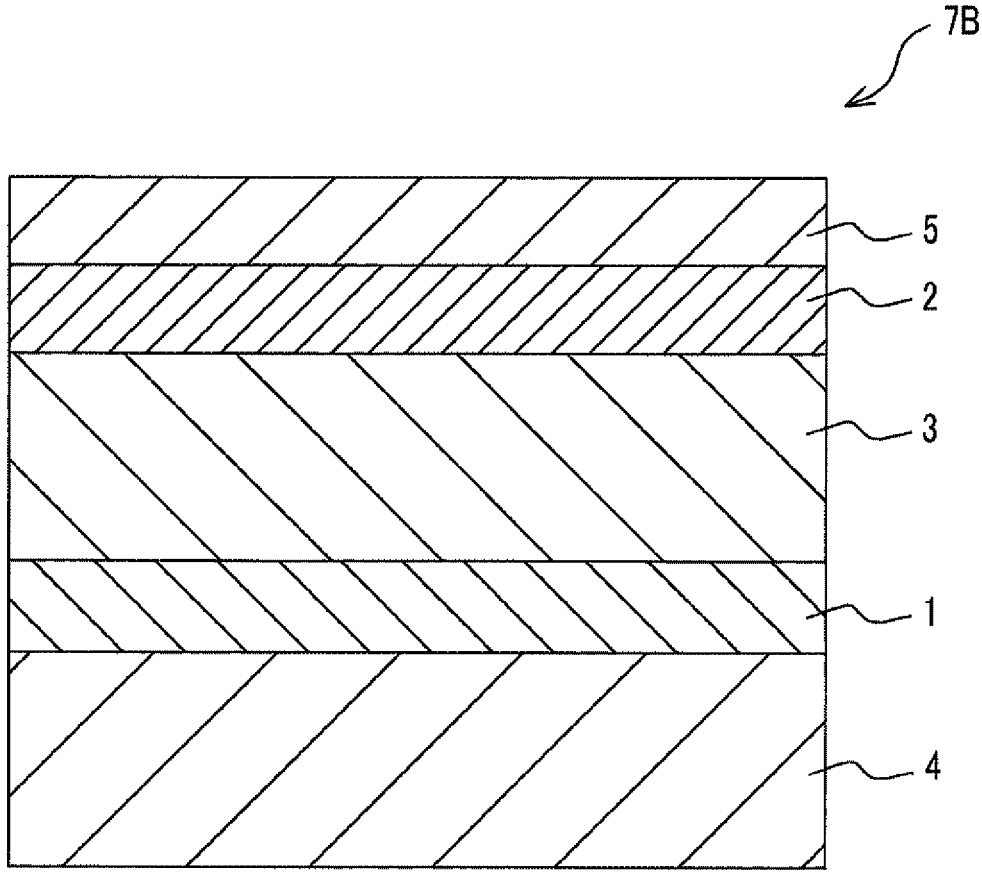
FIG. 2 is a schematic partial cross-sectional diagram showing the electrophotographic photoreceptor according to a second exemplary embodiment of the invention.

The electrophotographic photoreceptor 7B shown in FIG. 2 is a functionally separated type photoreceptor having the functions divided between a charge generating layer 2 and a charge transport layer 3, similarly to the electrophotographic photoreceptor 7B shown in FIG. 1, and has a structure in which an undercoat layer 1 is provided on a substrate 4, and a photosensitive layer having a charge transport layer 3 and a charge generating layer 2 sequentially formed is provided on the undercoat layer 1, with a protective layer 5 being provided on the photosensitive layer (second embodiment). In the electrophotographic photoreceptor 7B shown in FIG. 2, the substrate 4 corresponds to the substrate described above, the photosensitive layer composed of the charge transport layer 3 and the charge generating layer 2 corresponds to the photosensitive layer described above, and the protective layer 5 corresponds to the surface layer.

Figure 3:
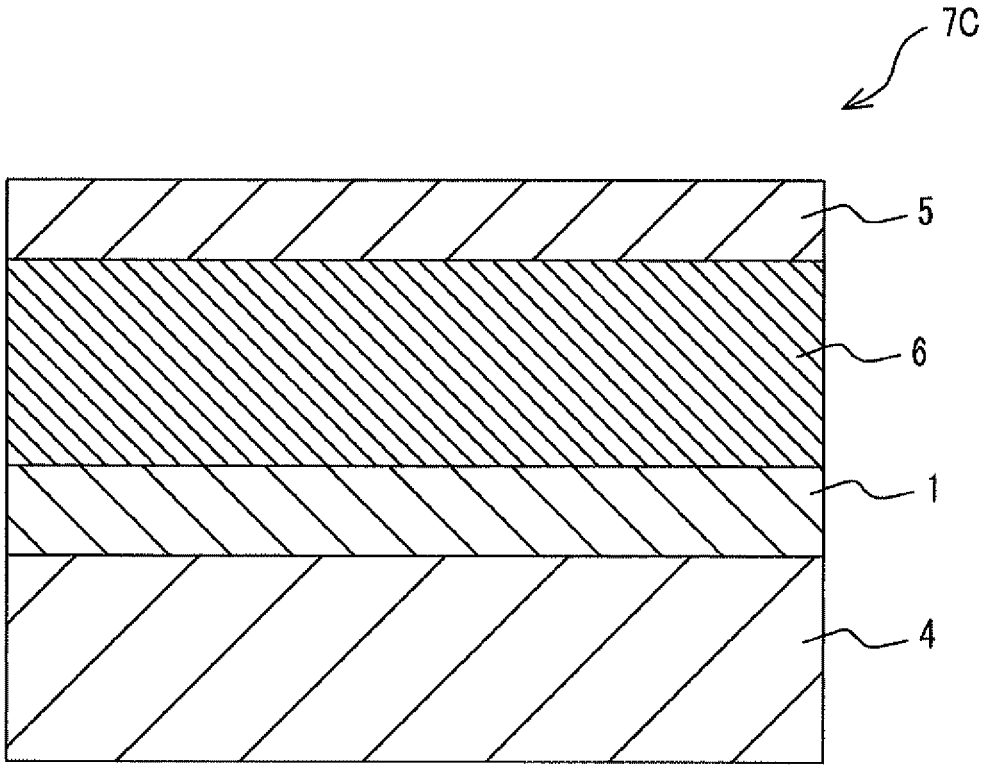
FIG. 3 is a schematic partial cross-sectional diagram showing the electrophotographic photoreceptor according to a third exemplary embodiment of the invention.

The electrophotographic photoreceptor 7C shown in FIG. 3 is a functionally integrated type photoreceptor containing a charge generating material and a charge transporting material in the same layer (charge generating/charge transport layer 6), and has a structure in which an undercoat layer 1 is provided on a substrate 4, and a charge generating/charge transport layer 6 and a protective layer 5 are sequentially formed on the undercoat layer 1. In the electrophotographic photoreceptor 7C, a single-layer type photosensitive layer composed of a charge generating/charge transport layer 6 is provided (third embodiment). Furthermore, in the electrophotographic photoreceptor 7C shown in FIG. 3, the substrate 4 corresponds to the substrate described above, the charge generating/charge transport layer 6 corresponds to the photosensitive layer described above, and the protective layer 5 corresponds to the surface layer.

In the electrophotographic photoreceptors shown in FIG. 1 to FIG. 3, the undercoat layer 1 may or may not be provided.

Hereinafter, the respective elements of the electrophotographic photoreceptor 7A shown in FIG. 1 as a representative example will be described.

First Embodiment

The electrophotographic photoreceptor 7A shown in FIG. 1 has a layer configuration in which, as described above, an undercoat layer 1, a charge generating layer 2, a charge transport layer 3, and a protective layer 5 are laminated in this order on a substrate 4.

Protective Layer 5

The protective layer 5, which is the surface layer, contains fluororesin particles as described above, and there are no particular limitations as long as the cross-section of the protective layer satisfies the formula (1) and the formula (2) described above. However, an example may be a protective layer containing the cross-linked product of a mixture containing the alkoxy compound and the hydroxy compound described above.

The thickness of the protective layer 5 is 4 μm or greater as described above, but may be from 1 μm to 15 μm (or from about 1 μm to about 15 μm), or may be from 6 μm to 10 μm (or from about 6 μm to about 10 μm).

The content of the fluororesin particles in the entire protective layer 5 may be, for example, from 1% by mass to 30% by mass (or from about 1% by mass to about 30% by mass), and the content may also be from 3% by mass to 20% by mass, or may be from 5% by mass to 12% by mass, based on the surface layer.

Furthermore, the protective layer 5 may further contain a fluoroalkyl group-containing copolymer. The amount of the fluoroalkyl group-containing copolymer added may be, for example, in the range of from 1 part by mass to 20 parts by mass based on 100 parts by mass of the fluororesin particles.

Particularly, the amount of the fluoroalkyl group-containing copolymer added which is desirable from the viewpoint of adjusting the values of $A_1$ and $A_2$ so as to satisfy the formula (1) and the formula (2), may vary with the type and particle size of the fluororesin particles, the type of the fluoroalkyl group-containing copolymer, and the like. For example, when PTFE particles having a particle size of 0.2 nm are used as the fluororesin particles, and GF400 (manufactured by Toagosei Co., Ltd.) is used as the fluoroalkyl group-containing copolymer, the amount of the fluoroalkyl group-containing copolymer added may be from 1 part by mass to 15 parts by mass, and the amount may be from 2.5 parts by mass to 10 parts by mass, or may be from 4 parts by mass to 7 parts by mass.

When the protective layer 5 contains the cross-linked product of a mixture containing the alkoxy compound and the hydroxy compound, the content of a component derived from the alkoxy compound in the cross-linked product may be, for example, in the range of from 0.1 time to 3.0 times the content of a component derived from the hydroxy compound, and the content may be from 0.2 time to 1.5 times, or may be from 0.3 time to 1.0 time, the content of a component derived from the hydroxy compound.

A specific example of the protective layer 5 may be a cured film containing the cross-linked product (hereinafter, may be referred to as a "specific cross-linked product") composed of at least one selected from a compound having a guanamine structure (hereinafter, may be referred to as "guanamine compound") and a compound having a melamine structure (hereinafter, may be referred to as "melamine compound"), a charge transporting material which is the alkoxy compound, and a charge transporting material which is the hydroxy compound. As the charge transporting material that forms the specific cross-linked product, another charge transporting material may also be used in combination, in addition to the alkoxy compound and the hydroxy compound.

Hereinafter, the charge transporting material which is an alkoxy compound, the charge transporting material which is a hydroxy compound, and the other charge transporting material may be collectively referred to as a "charge transporting material."

When the protective layer 5 contains the specific cross-linked product, the total content of the guanamine compound and the melamine compound based on the total amount of the specific cross-linked product (that is, the content of the compounds based on the total solids content excluding the fluororesin particles and the fluoroalkyl group-containing copolymer) may be, for example, in the range of from 0.1% by mass to 20% by mass, and the total content may be from 0.1% by mass to 5% by mass, or may be from 1% by mass to 3% by mass.

Furthermore, the content of the component derived from the alkoxy compound based on the total amount of the specific cross-linked product (that is, the content of the component based on the total solids content excluding the fluororesin particles and the fluoroalkyl group-containing copolymer) may be, for example, in the range of from 10% by mass to 70% by mass, and the content may be from 20% by mass to 50% by mass, or may be from 25% by mass to 45% by mass.

On the other hand, the content of the component derived from the hydroxy compound based on the total amount of the specific cross-linked product (that is, the content of the total solids content excluding the fluororesin particles and the fluoroalkyl group-containing copolymer) may be, for example, in the range of from 30% by mass to 90% by mass, and the content may be from 40% by mass to 75% by mass, or may be from 45% by mass to 60% by mass.

Furthermore, the content of the component derived from the charge transporting materials (the alkoxy compound, the hydroxy compound, and the other charge transporting material) based on the total amount of the specific cross-linked product (that is, the content of the charge transporting materials based on the total solids content excluding the fluororesin particles and the fluoroalkyl group-containing copolymer) may be, for example, 80% by mass or greater, and the content may be 90% by mass or greater, or may be 95% by mass or greater.

Hereinafter, the cured film containing the specific cross-linked product will be described in detail as an example of the protective layer 5, but the invention is not intended to be limited to this.

Fluororesin Particles

The fluororesin particles are not particularly limited as long as the particles are constituted to include a resin containing fluorine atoms, but examples include particles of a tetrafluoroethylene resin (PTFE), a trifluorochloroethylene resin, a hexafluoropropylene resin, a vinyl fluoride resin, a vinylidene fluoride resin, and a difluorodichloroethylene resin. These may be used individually, or two or more kinds may be used in combination.

The average primary particle size of the fluororesin particles may be from 0.05 μm to 1 μm (or from about 0.05 μm to about 1 μm), and may also be from 0.1 μm to 0.5 μm (or from about 0.1 μm to about 0.5 μm).

The average primary particle size of the fluororesin particles refers to the value measured using a laser diffraction type particle size distribution analyzer, LA-920 (manufactured by Horiba, Ltd.), by analyzing measurement liquid prepared by diluting a dispersion liquid having the fluororesin particles dispersed therein, with the same solvent, at a refractive index of 1.35.

Guanamine Compound

The guanamine compound is a compound having a guanamine skeleton (structure), and examples include acetoguanamine, benzoguanamine, formoguanamine, stearoguanamine, spiroguanamine, and cyclohexylguanamine.

Particularly, the guanamine compound is desirably at least one of a compound represented by the following formula (A) and multimers thereof. Here, the multimer is an oligomer obtained by polymerizing the compound represented by the formula (A) as a structural unit, and the degree of polymerization thereof is, for example, from 2 to 200 (desirably, from 2 to 100). The compound represented by the formula (A) may be used individually, but two or more kinds may also be used in combination.

Formula (A)

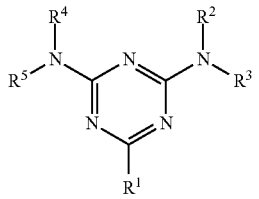

In the formula (A), $R^1$ represents a linear or branched alkyl group having from 1 to 10 carbon atoms, a substituted or unsubstituted phenyl group having from 6 to 10 carbon atoms, or a substituted or unsubstituted alicyclic hydrocarbon group having from 4 to 10 carbon atoms; $R^2$ to $R^5$ each independently represent a hydrogen atom, —$CH_2$—OH, or —$CH_2$—O—$R^6$; and $R^6$ represents a hydrogen atom, or a linear or branched alkyl group having from 1 to 10 carbon atoms.

In the formula (A), the alkyl group represented by $R^1$ has from 1 to 10 carbon atoms, but the alkyl group desirably has from 1 to 8 carbon atoms, and more desirably from 1 to 5 carbon atoms. Furthermore, the alkyl group may be linear, or may be branched.

In the formula (A), the phenyl group represented by $R^1$ has from 6 to 10 carbon atoms, but more desirably has from 6 to 8 carbon atoms. Examples of the substituent substituted on the phenyl group include a methyl group, an ethyl group, and a propyl group.

In the formula (A), the alicyclic hydrocarbon group represented by $R^1$ has from 4 to 10 carbon atoms, but more desirably has from 5 to 8 carbon atoms. Examples of the substituent substituted on the alicyclic hydrocarbon group include a methyl group, an ethyl group, and a propyl group.

In the formula (A), in the group "—$CH_2$—O—$R^6$" represented by $R^2$ to $R^5$, the alkyl group represented by $R^6$ has from 1 to 10 carbon atoms, but the alkyl group desirably has from 1 to 8 carbon atoms, and more desirably from 1 to 6 carbon atoms. The alkyl group may be linear, or may be branched. Desirable examples include a methyl group, an ethyl group, and a butyl group.

The compound represented by the formula (A) is particularly desirably a compound in which $R^1$ represents a substituted or unsubstituted phenyl group having from 6 to 10 carbon atoms; and $R^2$ to $R^5$ each independently represent —$CH_2$—O—$R^6$. Furthermore, $R^6$ is desirably selected from a methyl group and an n-butyl group.

The compound represented by the formula (A) is, for example, synthesized by a known method (for example, Lectures on Experimental Chemistry, $4^{th}$ Edition, Vol. 28, p. 430) using guanamine and formaldehyde.

Specific examples of the compound represented by the formula (A) will be shown below, but the examples are not limited to these. Furthermore, the following specific examples show monomers, but the compound represented by the formula (A) may be a multimer (oligomer) having these compounds as structural units.

(A)-1
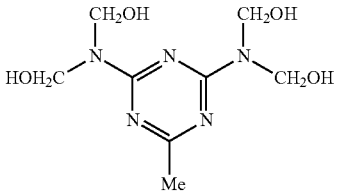
(A)-2
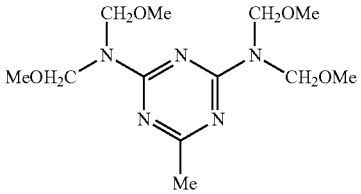
(A)-3
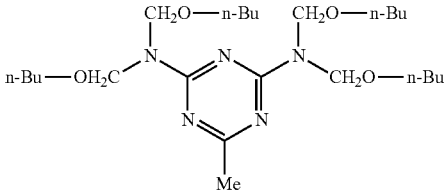
(A)-4
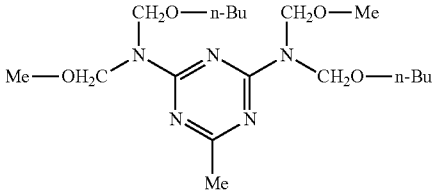
(A)-5
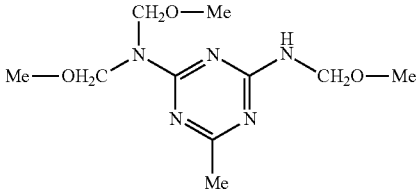
(A)-6
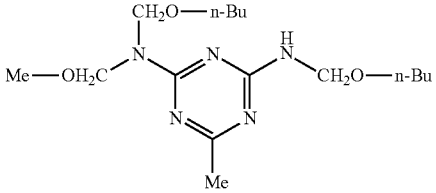
(A)-7
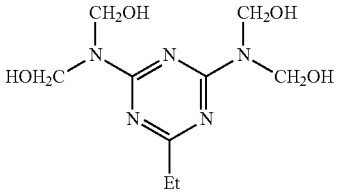
(A)-8
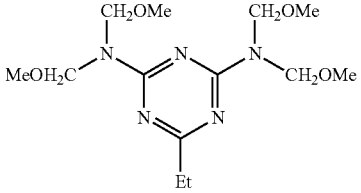
-continued
(A)-9
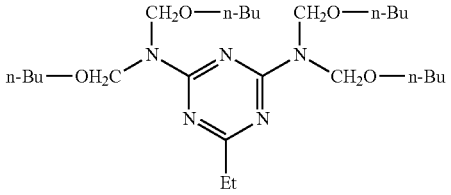
(A)-10
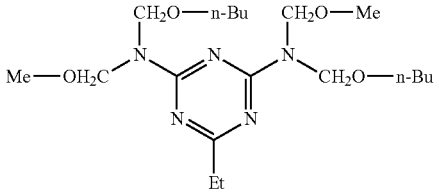
(A)-11
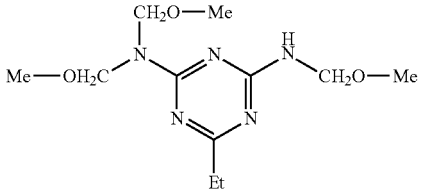
(A)-12
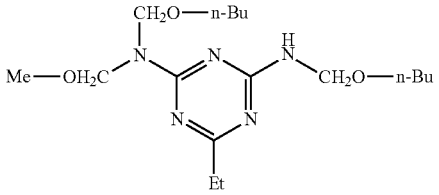
(A)-13
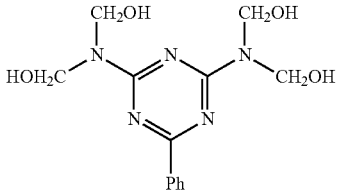
(A)-14
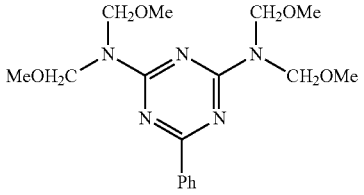
(A)-15
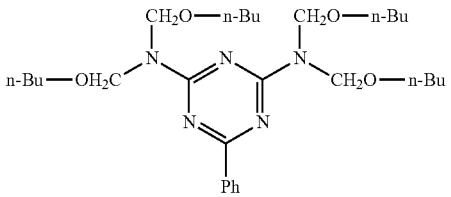
(A)-16
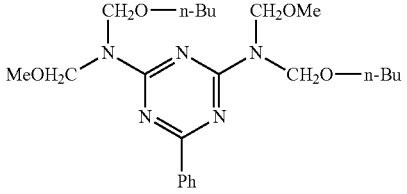

-continued
(A)-17
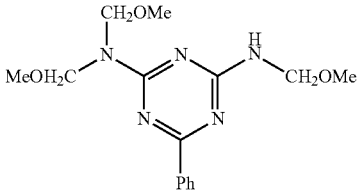
(A)-18
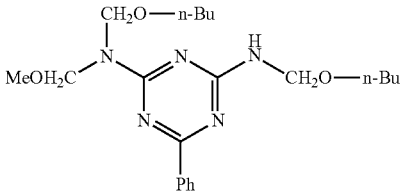
(A)-19
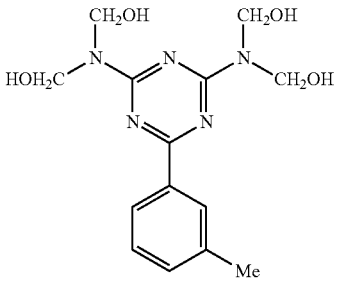
(A)-20
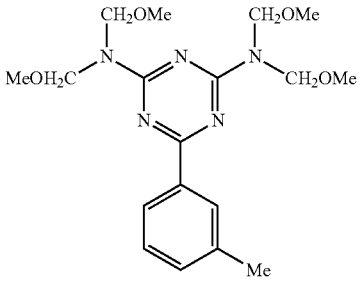
(A)-21
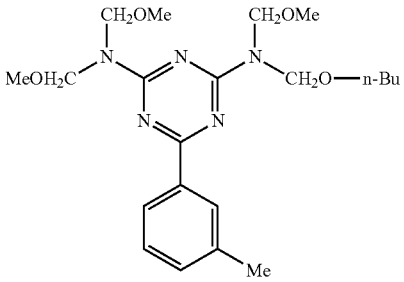
(A)-22
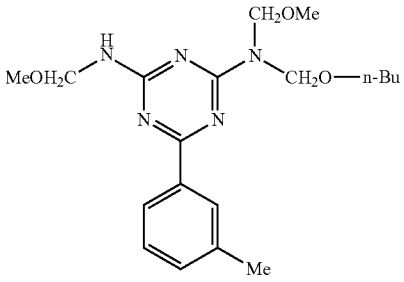
-continued
(A)-23
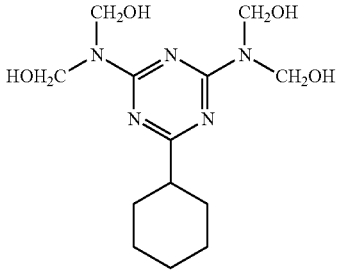
(A)-24
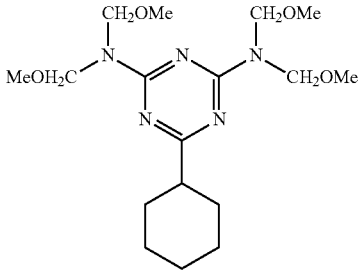
(A)-25
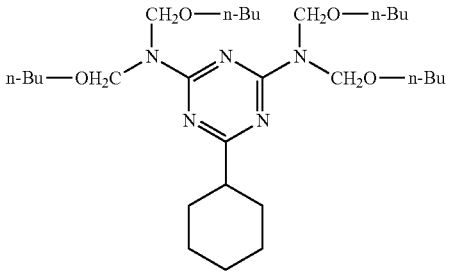
(A)-26
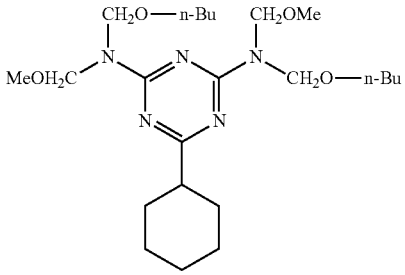
(A)-27
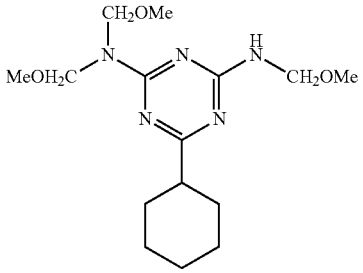

-continued
(A)-28
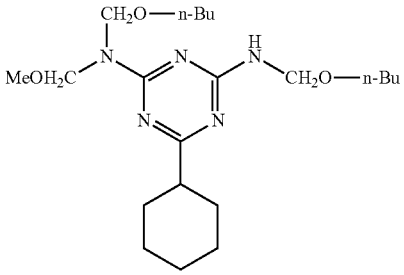
(A)-29
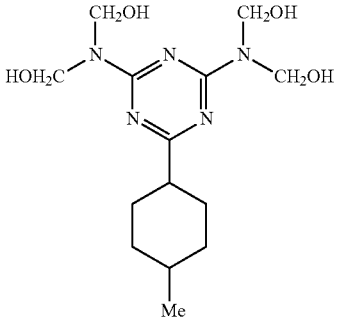
(A)-30
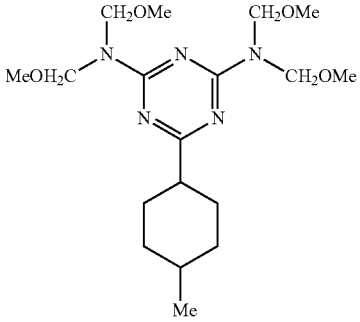
(A)-31
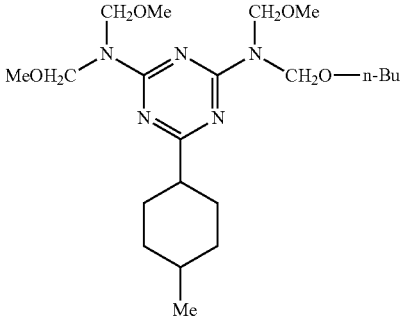
(A)-32
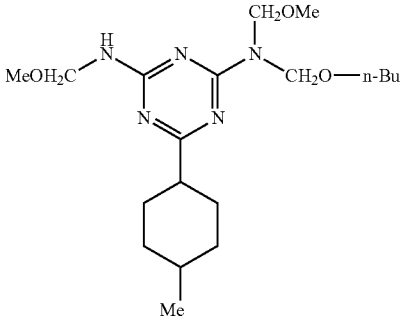
-continued
(A)-33
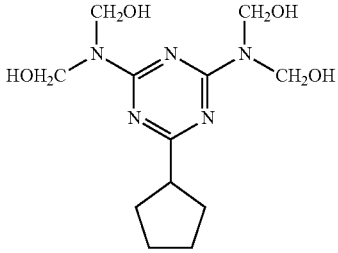
(A)-34
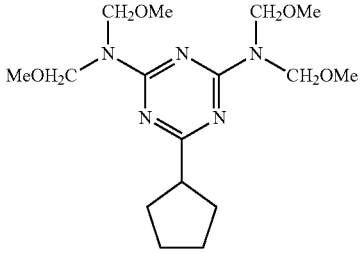
(A)-35
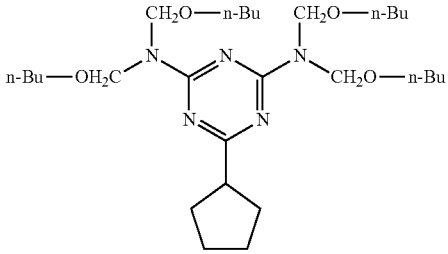
(A)-36
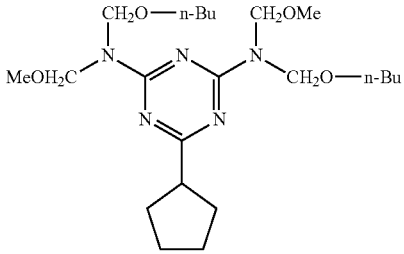
(A)-37
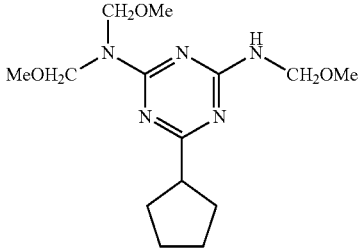
(A)-38
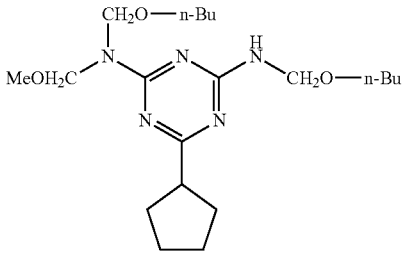

-continued (A)-39

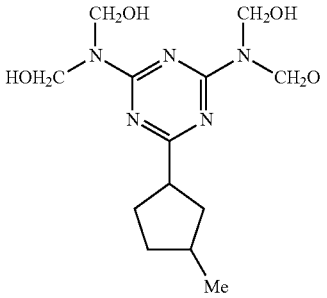

(A)-40

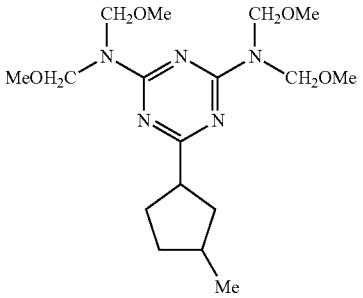

(A)-41

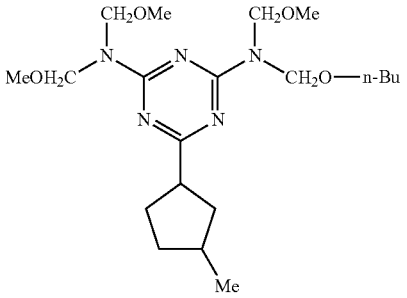

(A)-42

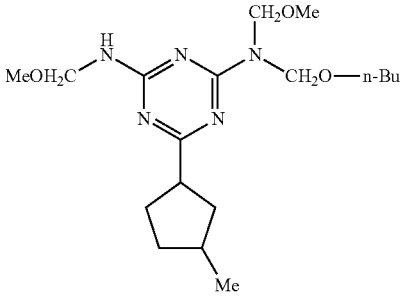

Examples of commercially available products of the compound presented by the formula (A) include "SUPER BECKAMINE® L-148-55, SUPER BECKAMINE® 13-535, SUPER BECKAMINE® L-145-60, SUPER BECKAMINE® TD-126", all manufactured by DIC Corp.; and "NIKALAC BL-60, and "NIKALAC BX-4000", all manufactured by Nippon Carbide Industries Co., Inc.

Furthermore, in order to remove the effect of residual catalyst after the synthesis or purchase of commercially available products, the compound (including multimers) represented by the formula (A) may be treated by dissolving the compound in an appropriate solvent such as toluene, xylene or ethyl acetate, and washing the solution with distilled water, ion-exchanged water or the like, or by treating the compound with an ion-exchange resin.

Melamine Compound

The melamine compound is desirably a compound having a melamine skeleton (structure), and particularly at least one of a compound represented by the following formula (B), and multimers thereof. Here, the multimer is an oligomer obtained by polymerizing the compound represented by the formula (B) as a structural unit, similarly to the case of the formula (A), and the degree of polymerization thereof is, for example, from 2 to 200 (desirably, from 2 to 100). The compound represented by the formula (B) or multimers thereof may be used individually, but two or more kinds may also be used in combination. Furthermore, the compound represented by the formula (B) or multimers thereof may also be used in combination with the compound represented by the formula (A) or multimers thereof.

Formula (B)

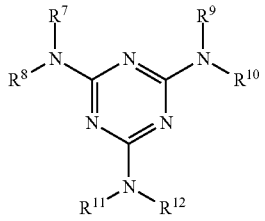

In the formula (B), $R^7$ to $R^{12}$ each independently represent a hydrogen atom, —$CH_2$—OH, or —$CH_2$—O—$R^{13}$; and $R^{13}$ represents an alkyl group having from 1 to 5 carbon atoms, which may be branched. Examples of $R^{13}$ include a methyl group, an ethyl group, and a butyl group.

The compound represented by the formula (B) is synthesized by, for example, a known method using melamine and formaldehyde (for example, synthesized in the same manner as for the melamine resin, as described in Lectures on Experimental Chemistry, $4^{th}$ Edition, vol. 28, p. 430).

Specific examples of the compound represented by the formula (B) will be shown below, but the examples are not limited to these. Furthermore, the following specific examples represent monomers, but multimers (oligomers) having these monomers as structural units may also be used.

(B)-1

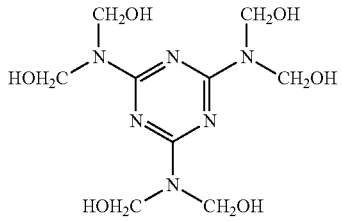

(B)-2

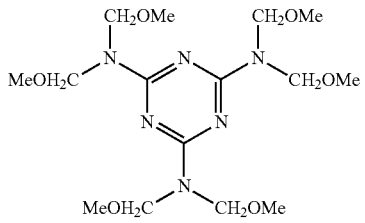

-continued (B)-3

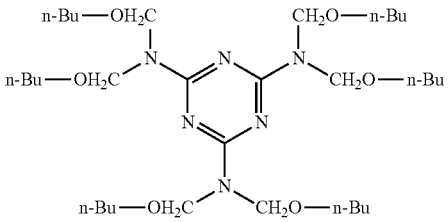

(B)-4

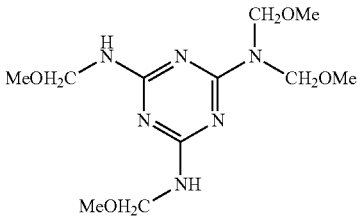

(B)-5

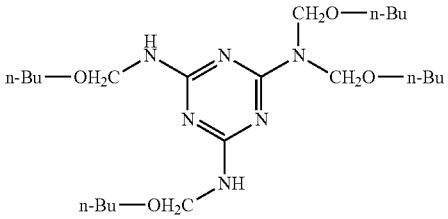

(B)-6

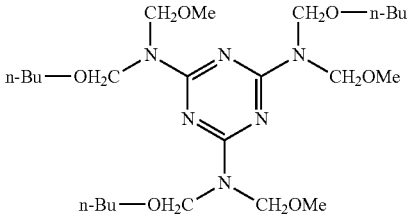

(B)-7

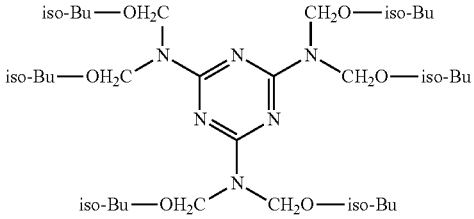

Examples of commercially available products of the compound represented by the formula (B) include SUPER MELAMI No. 90 (manufactured by NOF Corp.), SUPER BECKAMINE® TD-139-60 (manufactured by DIC Corp.), YUBAN 2020 (manufactured by Mitsui Chemicals, Inc.), SUMITEX RESIN M-3 (manufactured by Sumitomo Chemical Co., Ltd.), and NIKALAC MW-30 (manufactured by Nippon Carbide Industries Co., Inc.).

Furthermore, in order to remove the effect of residual catalyst after the synthesis or purchase of commercially available products, the compound (including multimers) represented by the formula (B) may be treated by dissolving the compound in an appropriate solvent such as toluene, xylene or ethyl acetate, and washing the solution with distilled water, ion-exchanged water or the like, or by treating the compound with an ion-exchange resin.

Charge Transporting Material

The charge transporting material which is an alkoxy compound, the charge transporting material which is a hydroxy compound, and the other charge transporting material (charge transporting material) will be described below.

The charge transporting material may be such that, for example, both the alkoxy compound and the hydroxy compound may be used as described above. The other charge transporting material may be, for example, a compound having at least one substituent selected from —$NH_2$, —SH and —COOH.

The charge transporting material may be, for example, a compound having two or more of the substituents (for example, an alkoxy group in the case of the alkoxy compound), and a compound having three or more of the substituents may also be used.

Specific examples of the charge transporting material include a compound represented by the following formula (I):

$$F—((—R^7—X)_{n1}(R^8)_{n3}—Y)_{n2} \quad (I)$$

In the formula (I), F represents an organic group derived from a compound having hole transporting ability; $R^7$ and $R^8$ each independently represent a linear or branched alkylene group having from 1 to 5 carbon atoms; n1 represents 0 or 1; n2 represents an integer from 1 to 4; n3 represents 0 or 1; X represents an oxygen atom, NH, or a sulfur atom; and Y represents —OH, —$OCH_3$, —$NH_2$, —SH or —COOH (that is, the specific reactive functional groups described above).

The compound having hole transporting ability for the organic group which is derived from a compound having hole transporting ability and represented by F in the formula (I), may be suitably an arylamine derivative. Suitable examples of the arylamine derivative include a triphenylamine derivative, and a tetraphenylbenzidine derivative.

The compound represented by the formula (I) is desirably a compound represented by the following formula (II).

(II)

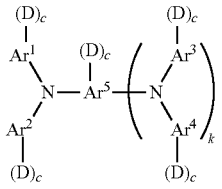

In the formula (II), $Ar^1$ to $Ar^4$ may be identical or different, and each independently represents a substituted or unsubstituted aryl group; $Ar^5$ represents a substituted or unsubstituted aryl group, or a substituted or unsubstituted arylene group; D represents —(—$R^7$—X)$_{n1}$($R^8$)$_{n3}$—Y; c's each independently represent 0 or 1; k represents 0 or 1; the total number of D's is from 1 to 4; $R^7$ and $R^8$ each independently represent a linear or branched alkylene group having from 1 to 5 carbon atoms; n1 represents 0 or 1; n3 represents 0 or 1; X represents an oxygen atom, NH, or a sulfur atom; Y represents —OH, —$OCH_3$, —$NH_2$, —SH, or —COOH.

In the formula (II), the group "—(—$R^7$—X)$_{n1}$($R^8$)$_{n3}$—Y" represented by D has the same definition as in the formula (I), and $R^7$ and $R^8$ each independently represent a linear or branched alkylene group having from 1 to 5 carbon atoms. Furthermore, n1 is desirably 1, and X is desirably an oxygen atom. Y is desirably a hydroxyl group.

The total number of D's in the formula (II) corresponds to n2 in the formula (I), and the total number is desirably from 2 to 4, and more desirably from 3 to 4. That is, it is desirable that the formula (I) or the formula (II) have from two to four, and more desirably from three to four, of the specific reactive functional groups in one molecule.

In the formula (II), $Ar^1$ to $Ar^4$ each desirably represent any one of the following formulas (1) to (7). Here, the following formulas (1) to (7) are collectively represented by "-$(D)_c$" which may be linked to each of $Ar^1$ to $Ar^4$.

(1)

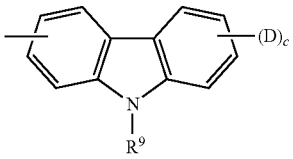

(2)

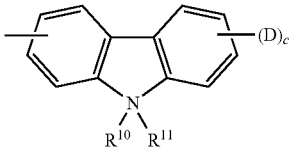

(3)

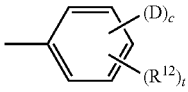

(4)

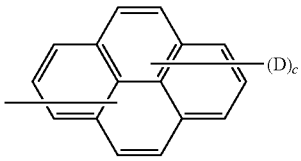

(5)

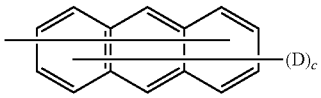

(6)

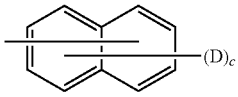

(7)

In the formulas (1) to (7), $R^9$ represents one selected from the group consisting of a hydrogen atom, an alkyl group having from 1 to 4 carbon atoms, a phenyl group substituted with an alkyl group having from 1 to 4 carbon atoms or an alkoxy group having from 1 to 4 carbon atoms, an unsubstituted phenyl group, and an aralkyl group having from 7 to 10 carbon atoms; $R^{10}$ to $R^{12}$ each represent one selected from the group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom; Ar represents a substituted or unsubstituted arylene group; D and c have the same meanings as "D" and "c" defined in the formula (II); s represents 0 or 1; and t represents an integer from 1 to 3.

Here, Ar in the formula (7) is desirably represented by the following formula (8) or (9).

(8)

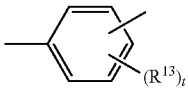

-continued (9)

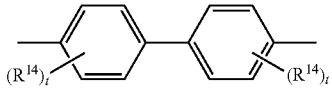

In the formulas (8) and (9), $R^{13}$ and $R^{14}$ each represent one selected from the group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom; and t represents an integer from 1 to 3.

Furthermore, Z' in the formula (7) desirably represents any one of the following formulas (10) to (17).

(10)

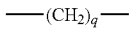

(11)

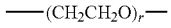

(12)

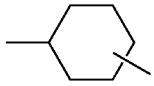

(13)

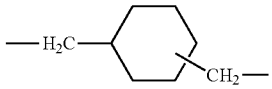

(14)

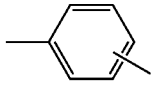

(15)

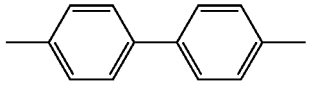

(16)

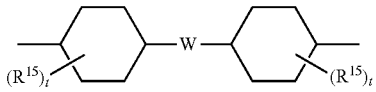

(17)

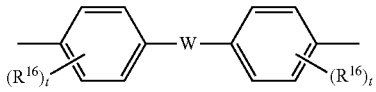

In the formulas (10) to (17), $R^{15}$ and $R^{16}$ each represent one selected from the group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom; W represents a divalent group; q and r each represent an integer from 1 to 10; and t's each represent an integer from 1 to 3.

W in the formula (16) or (17) is desirably any one of the divalent groups represented by the following formulas (18) to (26). However, in the formula (25), u represents an integer from 0 to 3.

(18)

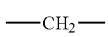

-continued

(19) $-C(CH_3)_2-$

(20) $-O-$

(21) $-S-$

(22) $-C(CF_3)_2-$

(23) $-Si(CH_3)_2-$ (24)

(25)

(26)

Furthermore, in the formula (II), $Ar^5$ represents, when k is 0, any one of the aryl group of the formulas (1) to (7) defined for $Ar^1$ to $Ar^4$, and when k is 1, $Ar^5$ is desirably an arylene group obtained by eliminating one hydrogen atom from any one of the aryl groups of the formulas (1) to (7).

Specific examples of the compound represented by the formula (I) include compounds (I-1) to (I-34) shown below. The compounds represented by the formula (I) are not intended to be limited to these.

I-1

I-2

-continued

I-3

I-4

I-5

I-6

I-7

-continued
I-8
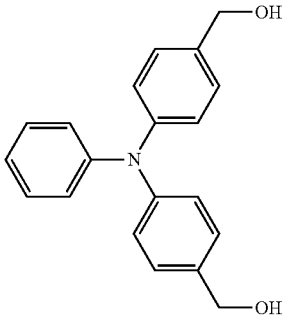
I-9
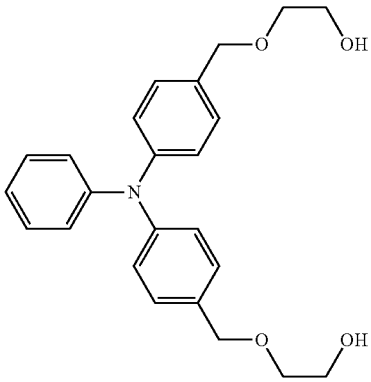
I-10
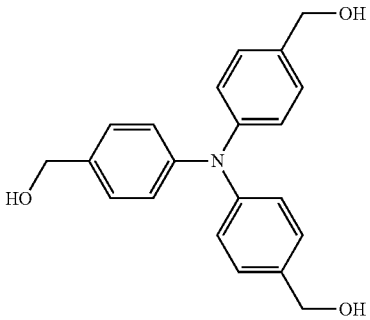
I-11
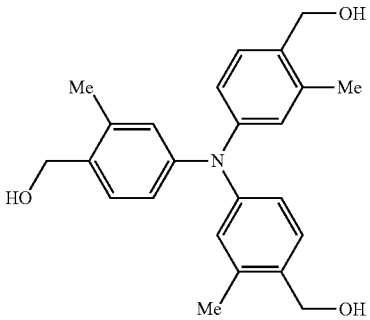
-continued
I-12
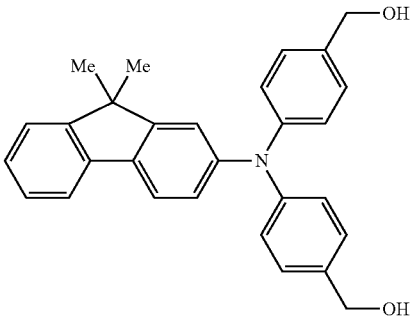
I-13
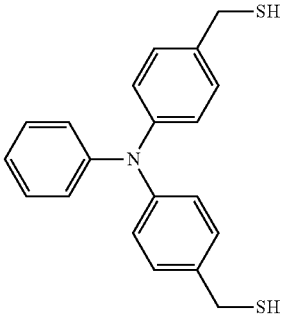
I-14
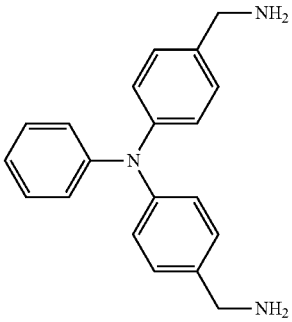
I-15
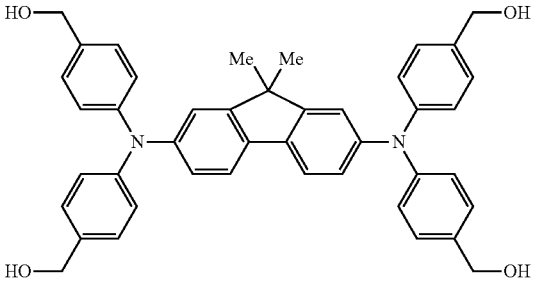
I-16
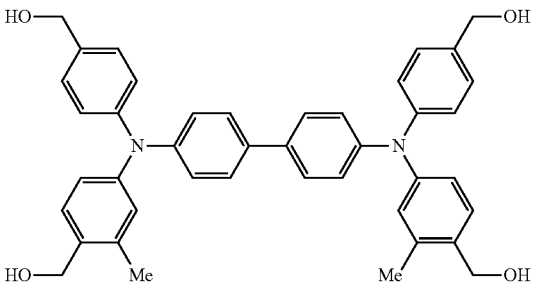

-continued
I-17
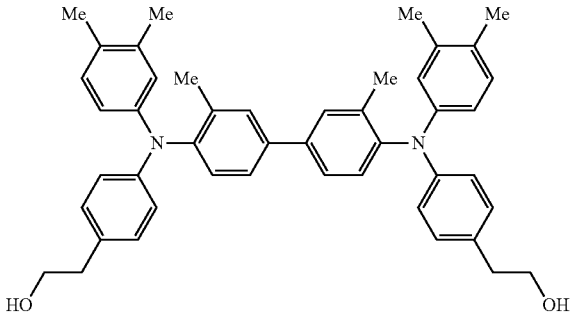
I-18
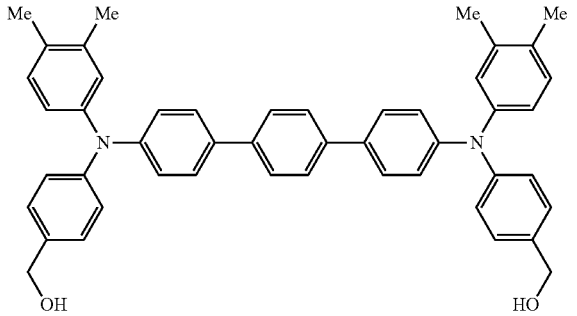
I-19
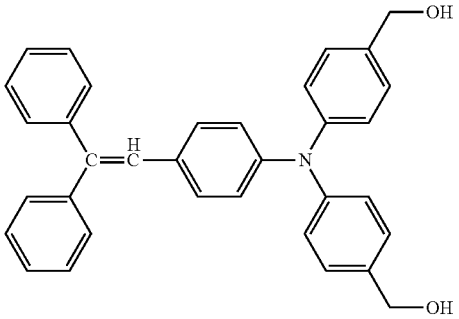
I-20
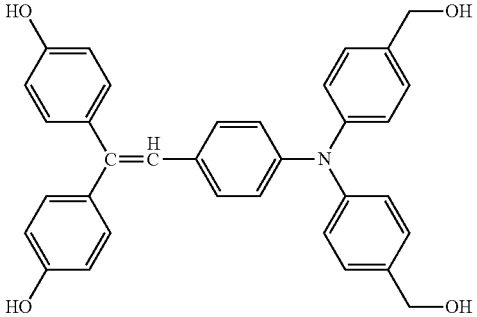
-continued
I-21
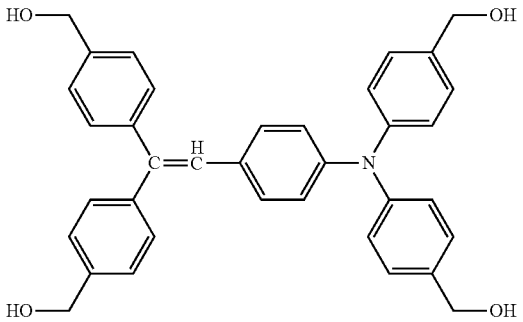
I-22
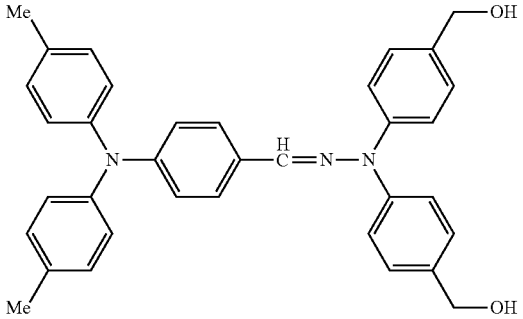
I-23
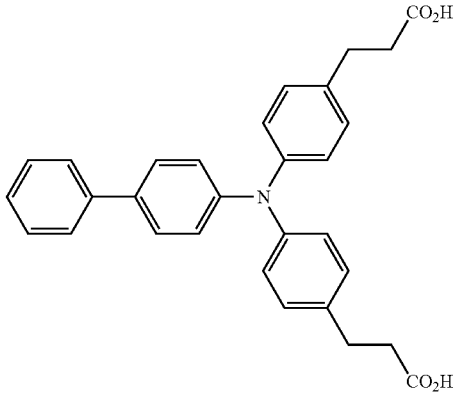
I-24
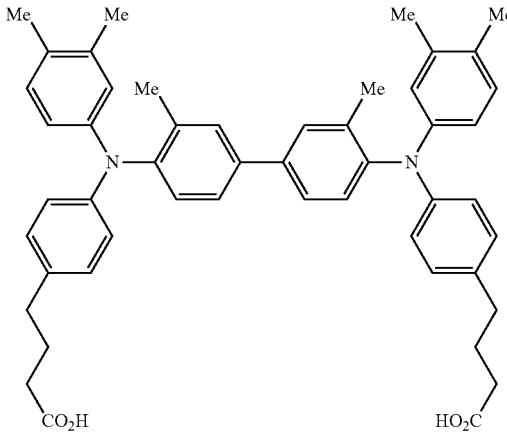

-continued
I-25
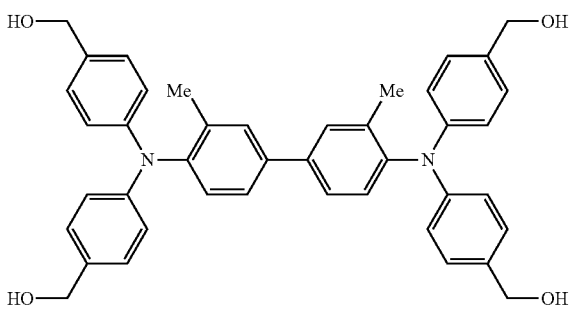
I-26
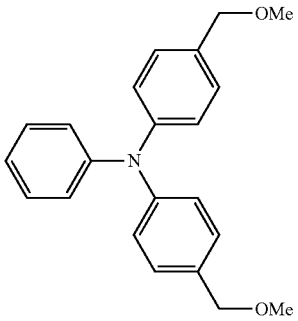
I-27
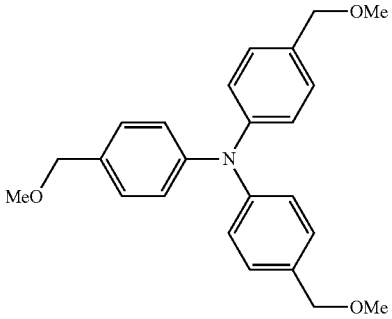
I-28
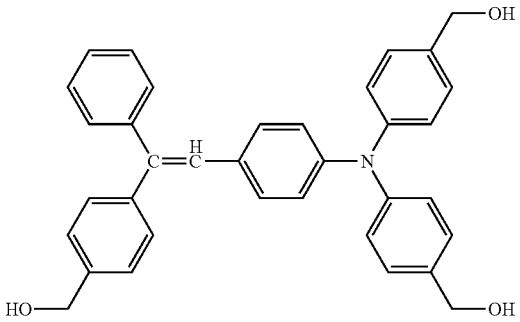
-continued
I-29
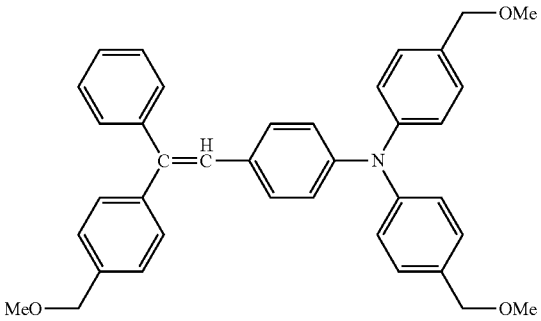
I-30
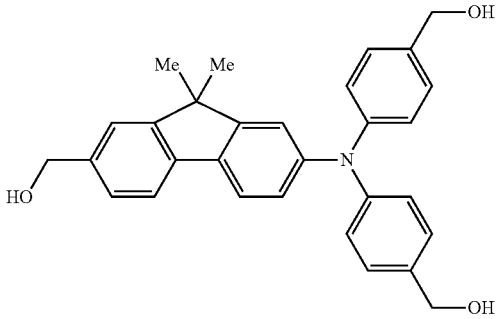
I-31
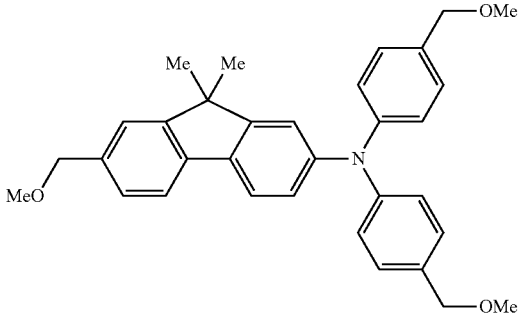
I-32
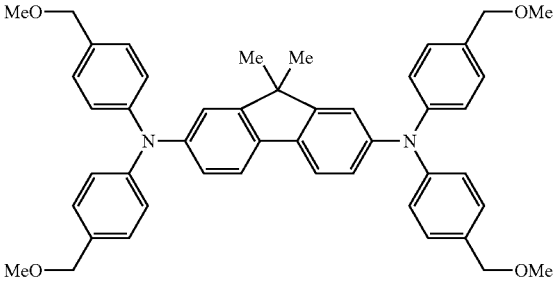
I-33
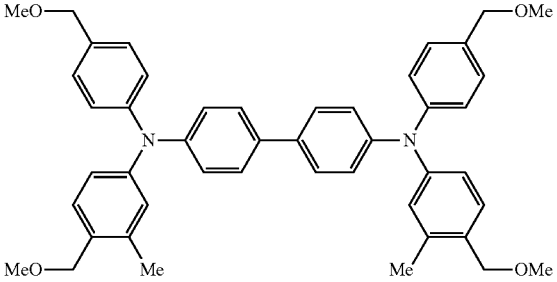

-continued

I-34

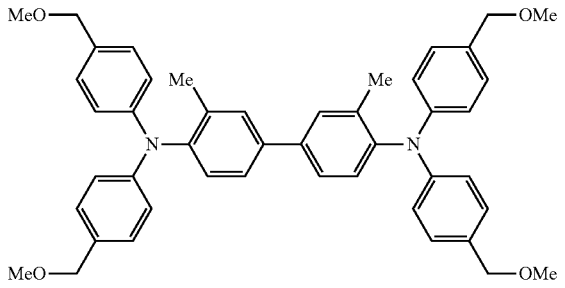

Other Components

The protective layer 5 may contain other components in addition to the fluororesin particles and the specific cross-linked product. Examples of the other components include, as described above, a fluoroalkyl group-containing copolymer as a dispersion aid.

The fluoroalkyl group-containing copolymer is not particularly limited, but may be, for example, a fluorine-based graft polymer including repeating units represented by the following structural formula (A) and structural formula (B). Specific examples include resins synthesized by, for example, graft polymerization using macromonomers formed from acrylic acid ester compounds, methacrylic acid ester compounds, or the like; perfluoroalkylethyl (meth)acrylates, and perfluoroalkyl(meth)acrylates. Here, the term (meth)acrylate means acrylate or methacrylate.

Structural Formula (A)

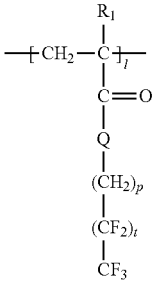

Structural Formula (B)

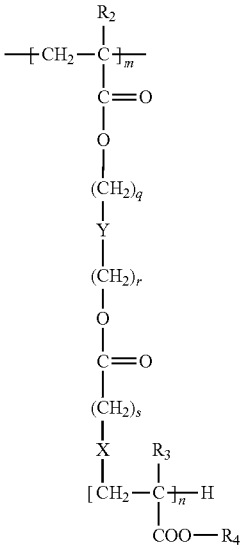

In the structural formula (A) and the structural formula (B), l, m and n each represent an integer of 1 or greater; p, q, r and s each represent an integer of 0 or 1 or greater; t represents an integer from 1 to 7; $R_1$, $R_2$, $R_3$ and $R_4$ each represent a hydrogen atom or an alkyl group; X represents an alkylene chain, a halogen-substituted alkylene chain, —S—, —O—, —NH— or a single bond; Y represents an alkylene chain, a halogen-substituted alkylene chain, —($C_zH_{2z-1}$(OH))—, or a single bond; z represents an integer of 1 or greater; and Q represents —O— or —NH—.

In the structural formula (A) and the structural formula (B), the alkyl group represented by $R_1$, $R_2$, $R_3$ and $R_4$ may be a methyl group, an ethyl group, and a propyl group. $R_1$, $R_2$, $R_3$ and $R_4$ are each desirably a hydrogen atom or a methyl group, and among these, a methyl group is more desirable.

For the fluoroalkyl group-containing copolymer, the content ratio of the structural formula (A) and the structural formula (B), that is, l:m, is desirably 1:9 to 9:1, and more desirably 3:7 to 7:3.

The weight average molecular weight of the fluoroalkyl group-containing copolymer is desirably from 10,000 to 100,000, and more desirably from 30,000 to 100,000.

Particularly, from the viewpoint of adjusting the values of $A_1$ and $A_2$ so as to satisfy the formula (1) and the formula (2), the desirable type of the fluoroalkyl group-containing copolymer may vary with the type and particle size of the fluororesin particles, or the like. For example, when PTFE particles having a particle size of 0.2 nm are used as the fluororesin particles, a desirable example of the fluoroalkyl group-containing copolymer may be GF400 (manufactured by Toagosei Co., Ltd.).

The protective layer 5 may use, as the other components, for example, another thermosetting resin such as a phenolic resin, a melamine resin, a urea resin, an alkyd resin or a benzoguanamine resin, as a mixture with the specific cross-linked product. Furthermore, a compound having a larger number of functional groups in one molecule, such as a spiroacetal-based guanamine resin (for example, "CTU-guanamine" (manufactured by Ajinomoto Fine Techno Co., Inc.)), may also be copolymerized with the materials in the cross-linked product.

Furthermore, the protective layer 5 may contain a surfactant. Suitable examples of the surfactant that may be used include surfactants containing a fluorine atom and at least one structure of an alkylene oxide structure and a silicone structure.

The protective layer 5 may contain an antioxidant. Desirable examples of the antioxidant include hindered phenol-based antioxidants and hindered amine-based antioxidants. Known antioxidants such as organosulfur-based antioxidants, phosphite-based antioxidants, dithiocarbamate-based antioxidants, thiourea-based antioxidants, and benzimidazole-based antioxidants may also be used. The amount of the antioxidant added is desirably 20% by mass or less, and more desirably 10% by mass or less.

The protective layer 5 may also contain oil such as silicone oil. Examples of the silicone oil include silicone oils such as dimethylpolysiloxane, diphenylpolysiloxane, and phenylmethylsiloxane; reactive silicone oils such as amino-modified polysiloxane, epoxy-modified polysiloxane, carboxy-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as (3,3,3-trifluoropropyl)methylcyclotrisiloxane; hydrosilyl group-containing cyclosiloxanes such as methylhydrosiloxane mixtures, pentamethylcyclopentasiloxane, and phenylhydrocyclosiloxane; and vinyl group-containing cyclosiloxanes such as pentavinylpentamethylcyclopentasiloxane.

The protective layer 5 may contain a curing catalyst for accelerating the curing of the guanamine compound and the melamine compound or the curing of the specific charge transporting material. An acid-based catalyst is desirably used as the curing catalyst. Examples of the acid-based catalyst that may be used include aliphatic carboxylic acids such as acetic acid, chloroacetic acid, trichloroacetic acid, trifluoroacetic acid, oxalic acid, maleic acid, malonic acid, and lactic acid; aromatic carboxylic acids such as benzoic acid, phthalic acid, terephthalic acid, and trimellitic acid; and aliphatic and aromatic sulfonic acids such as methanesulfonic acid, dodecylsulfonic acid, benzenesulfonic acid, dodecylbenzenesulfonic acid, and naphthalenesulfonic acid. However, it is desirable to use a sulfur-containing material.

The sulfur-containing material as the curing catalyst is desirably a material exhibiting acidity at normal temperature (for example, 25° C.) or after heating, and at least one of organic sulfonic acids and derivatives thereof is most desirable. The presence of such a curing catalyst in the protective layer 5 is easily confirmed by energy dispersive X-ray analysis (EDS), X-ray photoelectron spectroscopy (XPS), or the like.

Examples of the organic sulfonic acids and/or derivatives thereof include, for example, para-toluenesulfonic acid, dinonylnaphthalenesulfonic acid (DNNSA), dinonylnaphthalenedisulfonic acid (DNNDSA), dodecylbenzenesulfonic acid, and phenolsulfonic acid. Among these, para-toluensulfonic acid and dodecylbenzenesulfonic acid are desirable. Furthermore, an organic sulfonic acid salt may also be used as long as it is capable of dissociating in a curable resin composition.

Furthermore, a so-called thermal latent catalyst, which acquires higher catalytic capacity when heat is applied, may also be used.

Examples of the thermal latent catalyst include products produced by adsorbing acids or the like to vacancy compounds such as microcapsules in which organic sulfone compounds and the like are encapsulated with polymers into a particulate form, and zeolites; thermal latent protonic acid catalysts obtained by blocking protonic acids and/or protonic acid derivatives with bases; products obtained by esterifying protonic acids and/or protonic acid derivatives with primary or secondary alcohols; products obtained by blocking protonic acids and/or protonic acid derivatives with vinyl ethers and/or vinyl thioethers; boron trifluoride-monoethylamine complexes; and boron trifluoride-pyridine complexes.

Among them, the products obtained by blocking protonic acids and/or protonic acid derivatives with bases are desirable.

Examples of the protonic acids for the thermal latent protonic acid catalysts include sulfuric acid, hydrochloric acid, acetic acid, formic acid, nitric acid, phosphoric acid, sulfonic acid, monocarboxylic acids, polycarboxylic acids, propionic acid, oxalic acid, benzoic acid, acrylic acid, methacrylic acid, itaconic acid, phthalic acid, maleic acid, benzenesulfonic acid, o-toluenesulfonic acid, m-toluenesulfonic acid, p-toluenesulfonic acid, styrenesulfonic acid, dinonylnaphthalenesulfonic acid, dinonylnaphthalenedisulfonic acid, decylbenzenesulfonic acid, undecylbenzenesulfonic acid, tridecylbenzenesulfonic acid, tetradecylbenzenesulfonic acid, and dodecylbenzenesulfonic acid. Furthermore, examples of the protonic acid derivatives include neutralization products of alkali metal salts or alkaline earth metal salts of protonic acids such as sulfonic acid and phosphoric acid; and polymer compounds (polyvinylsulfonic acid, and the like) having a protonic acid skeleton introduced into the polymer chain. Examples of the bases blocking protonic acids include amines.

Examples of commercially available products include "NACURE 2501" (toluenesulfonic acid dissociation, methanol/isopropanol solvent, from pH 6.0 to pH 7.2, dissociation temperature 80° C.), "NACURE 2107" (p-toluenesulfonic acid dissociation, isopropanol solvent, from pH 8.0 to pH 9.0, dissociation temperature 90° C.), "NACURE 2500" (p-toluenesulfonic acid dissociation, isopropanol solvent, from pH 6.0 to pH 7.0, dissociation temperature 65° C.), "NACURE 2530" (p-toluenesulfonic acid dissociation, methanol/isopropanol solvent, from pH 5.7 to pH 6.5, dissociation temperature 65° C.), "NACURE 2547" (p-toluenesulfonic acid dissociation, aqueous solution, from pH 8.0 to pH 9.0, dissociation temperature 107° C.), "NACURE 2558" (p-toluenesulfonic acid dissociation, aqueous ethylene glycol solvent, from pH 3.5 to pH 4.5, dissociation temperature 80° C.), "NACURE XP-357" (p-toluenesulfonic acid dissociation, methanol solvent, from pH 2.0 to pH 4.0, dissociation temperature 65° C.), "NACURE XP-386" (p-toluenesulfonic acid dissociation, aqueous solution, from pH 6.1 to pH 6.4, dissociation temperature 80° C.), "NACURE XC-2211" (p-toluenesulfonic acid dissociation, from pH 7.2 to pH 8.5, dissociation temperature 80° C.), "NACURE 5225" (dodecylbenzenesulfonic acid dissociation, isopropanol solvent, from pH 6.0 to pH 7.0, dissociation temperature 120° C.), "NACURE 5414" (dodecylbenzenesulfonic acid dissociation, xylene solvent, dissociation temperature 120° C.), "NACURE 5528" (dodecylbenzenesulfonic acid dissociation, isopropanol solvent, from pH 7.0 to pH 8.0, dissociation temperature 120° C.), "NACURE 5925" (dodecylbenzenesulfonic acid dissociation, from pH 7.0 to pH 7.5, dissociation temperature 130° C.), "NACURE 1323" (dinonylnaphthalenesulfonic acid dissociation, xylene solvent, from pH 6.8 to pH 7.5, dissociation temperature 150° C.), "NACURE 1419" (dinonylnaphthalenesulfonic acid dissociation, xylene/methyl isobutyl ketone solvent, dissociation temperature 150° C.), "NACURE 1557" (dinonylnaphthalenesulfonic acid dissociation, butanol/2-butoxyethanol solvent, from pH 6.5 to pH 7.5, dissociation temperature 150° C.), "NACURE X49-110" (dinonylnaphthalenedisulfonic acid dissociation, isobutanol/isopropanol solvent, from pH 6.5 to pH 7.5, dissociation temperature 90° C.), "NACURE 3525" (dinonylnaphthalenedisulfonic acid dissociation, isobutanol/isopropanol solvent, from pH 7.0 to pH 8.5, dissociation temperature 120° C.), "NACURE XP-383" (dinonylnaphthalenedisulfonic acid dissociation, xylene solvent, dissociation temperature 120° C.), "NACURE 3327" (dinonylnaphthalenedisulfonic acid dissociation, isobutanol/isopropanol solvent, from pH 6.5 to pH 7.5, dissociation temperature 150° C.), "NACURE 4167" (phosphoric acid dissociation, isopropanol/isobutanol solvent, from pH 6.8 to pH 7.3, dissociation temperature 80° C.), "NACURE XP-297" (phosphoric acid dissociation, water/isopropanol solvent, from pH 6.5 to pH 7.5, dissociation temperature 90° C.), and "NACURE 4575" (phosphoric acid dissociation, from pH 7.0 to pH 8.0, dissociation temperature 110° C.), manufactured by King Industries, Inc.

These thermal latent catalysts may be used individually or in combination of two or more kinds.

Here, the amount of the catalyst incorporated may be, for example, in the range of from 0.1% by mass to 50% by mass based on the total solids content in the coating liquid, excluding the fluororesin particles and the fluoroalkyl group-containing copolymer, and the content may also be from 0.1% by mass to 30% by mass.

Method for Forming Protective Layer

The method for forming the protective layer 5 may be, for example, a method including a step of preparing a coating liquid for protective layer containing the fluororesin particles, the alkoxy compound and the hydroxy compound; a step of applying a coating liquid for protective layer on the outer peripheral surface of the charge transport layer 3; and a step of curing the coating liquid for protective layer applied on the outer peripheral surface of the charge transport layer 3 to form the protective layer 5.

For example, when the protective layer 5 contains, for example, the specific cross-linked product, a coating liquid for protective layer containing at least one selected from the fluororesin particles, guanamine compound and melamine compound, the charge transporting material which is an alkoxy compound, and the charge transporting material which is a hydroxy compound are used to form the protective layer 5. The constituent components of the protective layer 5 are added to this coating liquid for protective layer as necessary.

The preparation of the coating liquid for surface layer may be carried out without solvent, and if necessary, the preparation may be carried out using solvents such as alcohols such as methanol, ethanol, propanol and butanol; ketones such as acetone, and methyl ethyl ketone; and ethers such as tetrahydrofuran, diethyl ether, and dioxane. Such solvents may be used individually, or as mixtures of two or more kinds. However, a solvent having a boiling point of 100° C. or lower is desirably used.

Particularly, from the viewpoint of adjusting the values of $A_1$ and $A_2$ to satisfy the formula (1) and the formula (2), the desirable type of the solvent varies with the type and particle size of the fluororesin particles, the type and content of the alkoxy compound, the type and content of the hydroxy compound, the type and content of the fluoroalkyl group-containing copolymer, and the like.

For example, when the compound represented by the formula I-26 is used as the alkoxy compound, the compound represented by the formula I-16 is used as the hydroxy compound, PTFE particles having a particle size of 0.16 μm are used as the fluororesin particles, and GF400 (manufactured by Toagosei Co., Ltd.) is used as the fluoroalkyl group-containing copolymer, examples of the solvent that may be used include cyclopentanone, cyclohexanone, cyclopentyl methyl ether, THF, a mixed solvent of cyclopentanone and cyclopentanol, and a mixed solvent of THF and cyclopentanol. Furthermore, for example, when a mixed solvent of cyclopentanone and cyclopentanol is used under the conditions described above, the content of cyclopentanol in the mixed solvent may be, for example, in the range of from 10% by mass to 90% by mass, or may be from 40% by mass to 60% by mass.

The amount of the solvent is not particularly limited, but if the amount is too small, the guanamine compound and the melamine compound are easily precipitated out. Therefore, the solvent is used in an amount of, for example, from 0.5 part by mass to 30 parts by mass, and desirably from 1 part by mass to 20 parts by mass, based on 1 part by mass of the guanamine compound and the melamine compound.

Furthermore, when the components described above are made to react to obtain a coating liquid, the components may be simply mixed and dissolved. However, the components may also be heated to a temperature equal to or higher than room temperature (for example, 25° C.) and equal to or lower than 100° C., and desirably a temperature equal to or higher than 30° C. and equal to or lower than 80° C., for from 10 minutes to 100 hours, and desirably from 1 hour to 50 hours. At this time, it is also desirable to irradiate the coating liquid with ultrasonic waves.

The coating liquid for surface layer is applied on the charge transport layer 3 by a conventional method such as a blade coating method, a wire bar (Meyer bar) coating method, a spray coating method, a dip coating method, a bead coating method, an air knife coating method, or a curtain coating method, and if necessary, the coating liquid is cured by heating, for example, to a temperature of from 100° C. to 170° C. Thus, the protective layer 5 is obtained.

Substrate

As the substrate 4, an electrically conductive substrate is used, and examples include a metal plate, a metal drum and a metal belt, which are constructed using a metal such as aluminum, copper, zinc, stainless steel, chromium, nickel, molybdenum, vanadium, indium, gold or platinum, or an alloy; and a paper, a plastic film and a plastic belt, on which an electrically conductive compound such as a conductive polymer or indium oxide, a metal such as aluminum, palladium or gold, or an alloy is applied, deposited or laminated. Here, the "electrical conductivity" implies that the volume resistivity is less than $10^{13}$ Ω·cm.

When the photoreceptor according to the first embodiment is used in a laser printer, it is desirable that the surface of the substrate 4 be roughened to have a center line average roughness Ra of from 0.04 μm to 0.5 μm. However, in the case of using incoherent light as the light source, surface roughening need not be carried out in particular.

Desirable examples of the method for surface roughening include wet honing carried out by suspending a polishing agent in water and spraying the suspension onto the support; centerless grinding carried out by bringing the support into contact with a rotating whetstone and continuously performing grinding work; and anodization.

Another example of the method for surface roughening that may also be desirably used is a method of dispersing a conductive or semiconductive powder in a resin to form a layer on the support surface, and roughening the support surface by means of the particles dispersed in the layer, without actually roughening the surface of the substrate 4.

Here, the surface roughening treatment through anodization involves providing an anode made of aluminum and anodizing the anode in an electrolyte solution to thereby form an oxide film on the aluminum surface. Examples of the electrolyte solution include a sulfuric acid solution and an oxalic acid solution. However, since the porous anodized film formed by anodization is chemically active in the state as received, it is desirable to carry out a pore sealing treatment by which the fine pores of the anodized film are blocked through volumetric expansion caused by a hydration reaction in pressurized steam or boiling water (a metal salt of nickel or the like may be added), and the anodized film is converted to more stable hydrated oxide.

The thickness of the anodized film is desirably from 0.3 μm to 15 μm.

Furthermore, the substrate 4 may also be subjected to a treatment using an acidic aqueous solution or boehmite treatment.

The treatment using an acidic treatment liquid containing phosphoric acid, chromic acid and hydrofluoric acid is carried out as follows. First, an acidic treatment liquid is prepared. The mixing ratios of phosphoric acid, chromic acid and hydrofluoric acid in the acidic treatment liquid are such that the mixing ratio of phosphoric acid is in the range of from 10% by mass to 11% by mass, the mixing ratio of chromic acid is in the range of from 3% by mass to 5% by mass, and the mixing ratio of hydrofluoric acid is in the range of from 0.5% by mass to 2% by mass. The total concentration of these acids is desirably in the range of from 13.5% by mass to 18% by mass. The treatment temperature is desirably from 42° C. to 48° C. The thickness of the coating film is desirably from 0.3 μm to 15 μm.

The boehmite treatment is carried out by immersing the substrate in pure water at a temperature of from 90° C. to 100° C. for from 5 minutes to 60 minutes, or bringing the substrate into contact with heated steam at a temperature of from 90° C. to 120° C. for from 5 minutes to 60 minutes. The thickness of the film is desirably from 0.1 μm to 5 μm. This may be further anodized using an electrolyte solution having lower solubility for the coating film as compared with other kinds such as adipic acid, boric acid, a boric acid salt, a phosphoric acid salt, a phthalic acid salt, a maleic acid salt, a benzoic acid salt, a tartaric acid salt, and a citric acid salt.

Undercoat Layer

The undercoat layer 1 is composed of, for example, a layer containing inorganic particles in a binder resin.

As the inorganic particles, particles having powder resistance (volume resistivity) of from $10^2$ Ω·cm to $10^{11}$ Ω·cm are desirably used.

Among them, as the inorganic particles having such a resistance value, it is desirable to use inorganic particles of tin oxide, titanium oxide, zinc oxide, zirconium oxide or the like (electrically conductive metal oxide), and particularly, zinc oxide is desirably used.

Furthermore, the inorganic particles may be subjected to a surface treatment, and mixtures of two or more kinds of inorganic particles having different surface treatments or inorganic particles having different particle sizes may also be used. The volume average particle size of the inorganic particles is desirably in the range of from 50 nm to 2000 nm (desirably, from 60 nm to 1000 nm).

Inorganic particles having a specific surface area according to a BET method of 10 $m^2/g$ or larger are desirably used.

In addition to the inorganic particles, an acceptor compound may also be incorporated. Any acceptor compound may be used, but for example, electron-transporting substances such as quinone-based compounds such as chloranil and bromoanil; tetracyanoquinodimethane-based compounds; fluorenone compounds such as 2,4,7-trinitrofluorenone, and 2,4,5,7-tetranitro-9-fluorenone; oxadiazole-based compounds such as 2-(4-biphenyl)-5-(4-t-butylphenyl)-1,3,4-oxadiazole, 2,5-bis(4-naphthyl)-1,3,4-oxadiazole, 2,5-bis(4-diethylaminophenyl)-1,3,4-oxadiazole; xanthone-based compounds; thiophene compounds; and diphenoquinone compounds such as 3,3',5,5'-tetra-t-butyldiphenoquinone are desirable, and particularly, compounds having an anthraquinone structure are desirable. Furthermore, acceptor compounds having an anthraquinone structure, such as hydroxyanthraquinone-based compounds, aminoanthraquinone-based compounds, and aminohydroxyanthraquinone-based compounds are desirably used, and specific examples thereof include anthraquinone, alizarin, quinizarine, anthrarufin, and purpurin.

The content of these acceptor compounds is not particularly limited, but desirably, the acceptor compound is incorporated in an amount of from 0.01% by mass to 20% by mass, and more desirably from 0.05% by mass to 10% by mass.

The acceptor compound may be added only at the time of applying the undercoat layer 1, or may be adhered in advance to the surfaces of the inorganic particles. Examples of the method of applying an acceptor compound to the surfaces of the inorganic particles include a wet method and a dry method.

When a surface treatment is carried out by a dry method, the inorganic particles are treated by adding dropwise an acceptor compound directly or in the form of a solution in an organic solvent while stirring the inorganic particles with a mixer having a large shear force, and spraying the inorganic particles together with dry air or nitrogen gas. It is desirable to carry out the operation of addition or spraying at a temperature equal to or lower than the boiling point of the solvent. After the addition or spraying, the inorganic particles may also be subjected to baking at a temperature of 100° C. or higher. The baking process is not particularly limited in terms of temperature and time.

According to a wet method, the inorganic particles are stirred in a solvent and dispersed using an ultrasonicator, a sand mill, an attritor, a ball mill or the like, and an acceptor compound is added to the dispersion. The mixture is stirred or dispersed, and then the solvent is removed. The method for solvent removal is carried out by filtration or distilling off through distillation. After the solvent removal, the inorganic particles may be further subjected to baking at a temperature of 100° C. or higher. The baking process may be carried out in any range of conditions of temperature and time. In the wet method, the moisture contained in the inorganic particles may be removed before a surface treating agent is added, and for example, use may be made of a method of removing the moisture by stirring and heating the inorganic particles in a solvent that is used in the surface treatment, or a method of removing the moisture by azeotropically boiling with a solvent.

Furthermore, the inorganic particles may be subjected to a surface treatment before the acceptor compound is added. The surface treating agent is selected from known materials. Examples of the surface treating agent include a silane coupling agent, a titanate-based coupling agent, an aluminum-based coupling agent, and a surface active material. Particularly, a silane coupling agent is desirably used. Furthermore, a silane coupling agent having an amino group is desirably used.

Any compound may be used as the silane coupling agent having an amino group, but specific examples include γ-aminopropyltriethoxysilane, N-β-(aminoethyl)-γ-aminopropyltrimethoxysilane, N-β-(aminoethyl)-γ-aminopropylmethyldimethoxysilane, and N,N-bis(β-hydroxyethyl)-γ-aminopropyltriethoxysilane, but the examples are not limited to these.

Furthermore, the silane coupling agent may also be used as a mixture of two or more kinds. Examples of a silane coupling agent that may be used in combination with the silane coupling agent having an amino group include vinyltrimethoxysilane, γ-methacryloxypropyltris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane, but the examples are not limited to these.

The surface treatment method may be carried out using any known method, but a dry method or a wet method may be used. Furthermore, addition of an acceptor and a surface treatment using a coupling agent may be carried out in combination.

The amount of the silane coupling agent based on the inorganic particles in the undercoat layer 1 is not particularly limited, but the amount is desirably from 0.5% by mass to 10% by mass.

As the binder resin contained in the undercoat layer 1, any known binder resin may be used, but for example, known polymer resin compounds such as an acetal resin such as polyvinyl butyral, a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenolic resin, a phenol-formaldehyde resin, a melamine resin, and a urethane resin; charge transporting resins having a charge transporting group; and a conductive resin such as polyaniline, are desirably used. Among them, a resin which is insoluble in the coating solvent used in the upper layer is desirably used, and particularly a phenolic resin, a phenol-formaldehyde resin, a melamine resin, a urethane resin, an epoxy resin and the like are desirably used. When these are used in combination of two or more kinds, the mixing ratio is defined according to necessity.

The ratio of the metal oxide imparted with acceptor properties and the binder resin in the coating liquid for undercoat layer formation, or the ratio of the inorganic particles and the binder resin is not particularly limited.

Various additives may also be used in the undercoat layer 1. Examples of the additives which are used include known materials such as electron transporting pigments such as polycyclic fused ring-based pigments and azo-based pigments; zirconium chelate compounds, titanium chelate compounds, aluminum chelate compounds, titanium alkoxide compounds, organotitanium compounds, and silane coupling agents. The silane coupling agent is used in the surface treatment of the metal oxide, but the silane coupling agent may also be used in the coating liquid as an additive. Specific examples of the silane coupling agent used herein include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane.

Examples of the zirconium chelate compounds include zirconium butoxide, ethyl zirconium acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide and isostearate zirconium butoxide.

Examples of the titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolaminate, and polyhydroxytitanium stearate.

Examples of the aluminum chelate compounds include aluminum isopropylate, monobutoxyaluminum diisopropylate, aluminum butyrate, ethylacetoacetate aluminum diisopropylate, and aluminum tris(ethyl acetoacetate).

These compounds may be used alone, or as a mixture or a polycondensate of plural compounds.

The solvent for preparing the coating solution for undercoat layer formation may be appropriately selected from known organic solvents such as alcohol solvents, aromatic solvents, halogenated hydrocarbon solvents, ketone solvents, ketone alcohol solvents, ether solvents, and ester solvents. Examples of the solvent include conventional organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

These solvents used for such dispersion may be used alone or as a mixture of two or more kinds. As the solvent used for mixing, any solvent capable of dissolving a binder resin while being in the form of a mixed solvent, may be used.

As a method for dispersion, any known method of using a roll mill, a ball mill, a vibration ball mill, an attritor, a sand mill, a colloid mill and a paint shaker is used. Furthermore, as a coating method used for providing this undercoat layer 1, any of conventional methods such as a blade coating method, a wire bar coating method, a spray coating method, a dip coating method, a bead coating method, an air knife coating method and a curtain coating method is used.

The coating liquid for undercoat layer formation thus obtained is used to form the undercoat layer 1 on the substrate 4.

Furthermore, the undercoat layer 1 desirably has a Vickers hardness of 35 or greater.

Also, the undercoat layer 1 may have any thickness, but it is desirable that the undercoat layer 1 have a thickness of 5 μm or greater, and more desirably from 10 μm to 40 μm.

In order to prevent Moiré patterns, the surface roughness (ten-point average roughness) of the undercoat layer 1 is adjusted to a value between ¼n (n represents the refractive index of the upper layer) of the wavelength λ of the exposure laser used, and ½λ. In order to adjust the surface roughness, particles of a resin or the like may also be added to the undercoat layer. Examples of resin particles that may be used include silicone resin particles, and cross-linked type polymethyl methacrylate resin particles.

The undercoat layer may be polished for the adjustment of the surface roughness. Methods for polishing that may be used include buffing, sandblast treatment, wet honing, grinding treatment, and the like.

The undercoat layer is obtained by drying the applied coating, and the drying process is usually carried out at a temperature at which a film may be formed by evaporating the solvent.

Charge Generating Layer

The charge generating layer 2 is desirably a layer containing at least a charge generating material and a binder resin.

Examples of the charge generating material include azo pigments such as bisazo and trisazo, condensed-ring aromatic pigments such as dibromoanthanthrone, perylene pigments, pyrrolopyrrole pigments, phthalocyanine pigments, zinc oxide, and trigonal selenium. Among these, for the exposure with a laser light in the near-infrared region, metallic and/or metal-free phthalocyanine pigments are desirable, and particularly, hydroxygallium phthalocyanines disclosed in JP-A-5-263007 and JP-A-5-279591; chlorogallium phthalocyanines disclosed in JP-A-5-98181; dichlorotin phthalocyanines disclosed in JP-A-5-140472 and JP-A-5-140473; and titanyl phthalocyanines disclosed in JP-A-4-189873 and JP-A-5-43823 are more desirable. Furthermore, condensed-ring aromatic pigments such as dibromoanthanthrone, thioindigo pigments, porphyrazine compounds, zinc oxide, trigonal selenium and the like are more desirable for the exposure to laser light in the near-ultraviolet region. As the charge generating material, in the case of using a light source having an exposure wavelength of from 380 nm to 500 nm, inorganic pigments are desirable, and in the case of using a light source having an exposure wavelength of from 700 nm to 800 nm, metallic and metal-free phthalocyanines are desirable.

As the charge generating material, it is desirable to use a hydroxygallium phthalocyanine pigment having a maximum peak wavelength in the range of from 810 nm to 839 nm in the spectroscopic absorption spectrum in the wavelength region of from 600 nm to 900 nm. This hydroxygallium phthalocyanine pigment is different from the conventional V-type hydroxygallium phthalocyanine pigments, and is a pigment for which the maximum peak wavelength of the spectroscopic absorption spectrum has been shifted to the shorter wavelength side than the maximum peak wavelength of the conventional V-type hydroxygallium phthalocyanine pigments.

Furthermore, as the hydroxygallium phthalocyanine pigments having a maximum peak wavelength in the range of from 810 nm to 839 nm, a hydroxygallium phthalocyanine pigment having an average particle size in a specific range and having a BET specific surface area in a specific range is desirable. Specifically, it is desirable that the hydroxygallium phthalocyanine pigment have an average particle size of 0.20 μm or less, and more desirably from 0.01 μm to 0.15 μm, and have a BET specific surface area of 45 $m^2/g$ or larger, more desirably 50 $m^2/g$ or larger, and particularly desirably from 55 $m^2/g$ to 120 $m^2/g$. The average particle size is the volume average particle size (d50 average particle size), and is a value measured using a laser diffraction-scattering type particle size distribution analyzer (LA-700, manufactured by Horiba, Ltd.). Furthermore, the BET type specific surface area is a value measured by a nitrogen adsorption method using a BET type specific surface area analyzer (FLOW SORB II2300; manufactured by Shimadzu Corp.).

Furthermore, the maximum particle size (maximum value of primary particle size) of the hydroxygallium phthalocyanine pigment is desirably 1.2 μm or less, more desirably 1.0 μm or less, and even more desirably 0.3 μm or less.

The hydroxygallium phthalocyanine pigment desirably has an average particle size of 0.2 μm or less, a maximum particle size of 1.2 μm or less, and a specific surface area value of 45 $m^2/g$ or larger.

The hydroxygallium phthalocyanine pigment desirably has diffraction peaks at Bragg's angles (2θ±0.2°) of 7.5°, 9.9°, 12.5°, 16.3°, 18.6°, 25.1° and 28.3° in the X-ray diffraction spectrum obtained by using CuKα characteristic X-rays.

The hydroxygallium phthalocyanine pigment desirably has a rate of thermal weight loss resulting from a temperature increase from 25° C. to 400° C., of from 2.0% to 4.0%, and more desirably from 2.5% to 3.8%.

The binder resin used in the charge generating layer 2 is selected from a wide variety of insulating resins, and may also be selected from organic photoconductive polymers such as poly-N-vinylcarbazole, polyvinylanthracene, polyvinylpyrene, and polysilanes. Desirable examples of the binder resin include a polyvinyl butyral resin, a polyallylate resin (a polycondensate of a bisphenol and an aromatic divalent carboxylic acid, or the like), a polycarbonate resin, a polyester resin, a phenoxy resin, a vinyl chloride-vinyl acetate copolymer, a polyimide resin, an acrylic resin, a polyacrylamide resin, a polyvinylpyridine resin, a cellulose resin, a urethane resin, an epoxy resin, casein, a polyvinyl alcohol resin, and a polyvinylpyrrolidone resin. These binder resins are used individually, or as mixtures of two or more kinds. The mixing ratio of the charge generating material and the binder resin is desirably in the range of from 10:1 to 1:10 on a mass basis. Here, the term "insulating" means that the volume resistivity is $10^{13}$ Ω·cm or greater.

The charge generating layer 2 is formed by, for example, using a coating liquid in which the charge generating material and the binder resin are dispersed in a solvent.

Examples of the solvent used in dispersion include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents are used individually or as mixtures of two or more kinds.

As the method of dispersing the charge generating material and the binder resin in a solvent, a conventional method such as a ball mill dispersion method, an attritor dispersion method, or a sand mill dispersion method, is used. Furthermore, during this dispersion, it is effective to adjust the average particle size of the charge generating material to 0.5 μm or less, desirably 0.3 μm or less, and more desirably 0.15 μm or less.

Furthermore, in order to form a charge generating layer 2, a conventional method such as a blade coating method, a wire bar coating method, a spray coating method, a dip coating method, a bead coating method, an air knife coating method or a curtain coating method, is used.

The thickness of the charge generating layer 2 thus obtained is desirably from 0.1 μm to 5.0 μm, and more desirably from 0.2 μm to 2.0 μm.

Charge Transport Layer

The charge transport layer 3 is desirably a layer containing at least a charge transporting material and a binder resin, or a layer containing a polymer charge transporting material.

Examples of the charge transporting material include electron transporting compounds such as quinone compounds such as p-benzoquinone, chloranil, bromanil, and anthraquinone, tetracyanoquinodimethane compounds, fluorenone compounds such as 2,4,7-trinitrofluorenone, xanthone compounds, benzophenone compounds, cyanovinyl compounds, and ethylene compounds; and hole transporting compounds such as triarylamine compounds, benzidine compounds, arylalkane compounds, aryl-substituted ethylene compounds, stilbene compounds, anthracene compounds, and hydrazone compounds. These charge transporting materials are used individually or as mixtures of two or more kinds, but the examples are not limited to these.

The charge transporting material is desirably a triarylamine derivative represented by the following structural formula (a-1), or a benzidine derivative represented by the following structural formula (a-2), from the viewpoint of charge mobility.

(a-1)

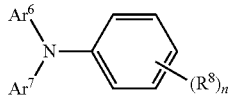

In the structural formula (a-1), $R^8$ represents a hydrogen atom or a methyl group; n represents 1 or 2; $Ar^6$ and $Ar^7$ each independently represent a substituted or unsubstituted aryl group, $—C_6H_4—C(R^9)=C(R^{10})(R^{11})$, or $—C_6H_4—CH=CH—CH=C(R^{12})(R^{13})$; $R^9$ to $R^{13}$ each independently represent a hydrogen atom, a substituted or unsubstituted alkyl group, or a substituted or unsubstituted aryl group; and examples of the substituent include a halogen atom, an alkyl group having 1 to 5 carbon atoms, an alkoxy group having 1 to 5 carbon atoms, and an amino group substituted with an alkyl group having 1 to 3 carbon atoms.

(a-2)

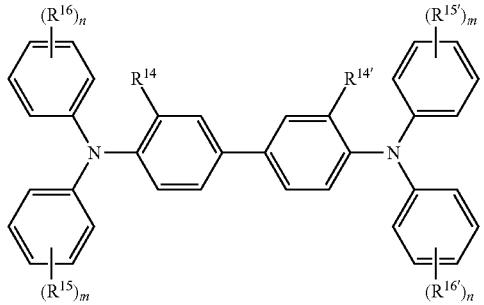

In the structural formula (a-2), $R^{14}$ and $R^{14'}$ may be identical or different, and each independently represents a hydrogen atom, a halogen atom, an alkyl group having 1 to 5 carbon atoms, or an alkoxy group having 1 to 5 carbon atoms; $R^{15}$, $R^{15'}$, $R^{16}$ and $R^{16'}$ may be identical or different, and each independently represents a hydrogen atom, a halogen atom, an alkyl group having 1 to 5 carbon atoms, an alkoxy group having 1 to 5 carbon atoms, an amino group substituted with an alkyl group having 1 to 2 carbon atoms, a substituted or unsubstituted aryl group, $—C(R^{17})=C(R^{18})(R^{19})$, or $—CH=CH—CH=C(R^{20})(R^{21})$; $R^{17}$ to $R^{21}$ each independently represent a hydrogen atom, a substituted or unsubstituted alkyl group, or a substituted or unsubstituted aryl group; and m and n each independently represent an integer from 0 to 2.

Here, among the triarylamine derivatives represented by the structural formula (a-1) and the benzidine derivatives represented by the structural formula (a-2), particularly a triarylamine derivative having "$—C_6H_4—CH=CH—CH=C(R^{12})(R^{13})$" and a benzidine derivative having "$—CH=CH—CH=C(R^{20})(R^{21})$" are desirable.

Examples of the binder resin (resin for charge transport layer) used in the charge transporting layer 3 include a polycarbonate resin, a polyester resin, a polyallylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, a styrene-alkyd resin, poly-N-vinylcarbazole, and polysilane. Also, as described above, polymer charge transporting materials such as the polyester-based polymer charge transporting materials disclosed in JP-A-8-176293 and JP-A-8-208820 may also be used. These binder resins are used individually or as mixtures of two or more kinds. The mixing ratio of the charge transporting material and the binder resin is desirably from 10:1 to 1:5 on a mass basis.

The binder resin is not particularly limited, but at least one of a polycarbonate resin having a viscosity average molecular weight of from 50,000 to 80,000, and a polyallylate resin having a viscosity average molecular weight of from 50,000 to 80,000 is desirable.

A polymer charge transporting material may also be used as the charge transporting material. As the polymer charge transporting material, known polymers having charge transportability, such as poly-N-vinylcarbazole and polysilane are used. Especially, the polyester-based polymer charge transporting materials disclosed in JP-A-8-176293, JP-A-8-208820 and the like are particularly desirable. The polymer charge transporting material is capable of forming a film simply by itself, but the polymer charge transporting material may be mixed with a binder resin that will be described later and used in film formation.

The charge transport layer 3 is formed by, for example, using a coating liquid for charge transport layer formation containing the constituent materials described above. As the solvent used in the coating liquid for charge transport layer formation, conventional organic solvents such as aromatic hydrocarbons such as benzene, toluene, xylene, and chlorobenzene; ketones such as acetone and 2-butanone; halogenated aliphatic hydrocarbons such as methylene chloride, chloroform, and ethylene chloride; cyclic or linear ethers such as tetrahydrofuran, and ethyl ether, are used individually or as mixtures of two or more kinds. As the method of dispersing the various constituent materials, any known method is used.

As the method of coating used when the coating liquid for charge transport layer formation is applied on the charge generating layer 2, a conventional method such as a blade coating method, a wire bar coating method, a spray coating method, a dip coating method, a bead coating method, an air knife coating method, or a curtain coating method is used.

The thickness of the charge transport layer 3 is desirably from 5 μm to 50 and more desirably from 10 μm to 30 μm.

The respective layers constituting the photosensitive layer in the electrophotographic photoreceptors 7A to 7C shown in FIG. 1 to FIG. 3 may contain, for example, additives such as an antioxidant, a light stabilizer, and a thermal stabilizer in the respective layers constituting the photosensitive layer. Examples of the antioxidant include hindered phenols, hindered amines, para-phenylenediamine, arylalkanes, hydroquinone, spirochromane, spiroindanone, derivatives thereof, organosulfur compounds, and organophosphorus compounds.

Examples of the light stabilizer include derivatives of benzophenone, benzotriazole, dithiocarbamate, and tetramethylpiperidine.

Furthermore, the photosensitive layer may also contain an electron-acceptor substance. Examples of the electron-acceptor substance include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, phthalic acid, and the curable resins used in the surface layer.

The surface layer 5 in the electrophotographic photoreceptors 7A to 7C shown in FIG. 1 to FIG. 3 may be treated with an aqueous dispersion liquid containing a fluororesin.

<Process Cartridge and Image Forming Apparatus>

Next, a process cartridge and an image forming apparatus using the electrophotographic photoreceptor of the exemplary embodiment will be described.

The process cartridge of the exemplary embodiment is not particularly limited as long as the process cartridge uses the electrophotographic photoreceptor of the exemplary embodiment. However, specifically, the process cartridge is a member that is detachable to an image forming apparatus which develops an electrostatic latent image on the surface of a latent image holding member, transfers the toner image thus obtained to a recording medium, and forms an image on the recording medium, and has a configuration including the electrophotographic photoreceptor according to the exemplary embodiment as the latent image holding member, and at least one selected from a charging unit, a developing unit and a cleaning unit.

The image forming apparatus of the exemplary embodiment of the invention is not particularly limited as long as the apparatus uses the electrophotographic photoreceptor of the exemplary embodiment. However, specifically, it is desirable that the image forming apparatus have a configuration including the electrophotographic photoreceptor according to the exemplary embodiment of the invention, a charging unit that charges the electrophotographic photoreceptor, a latent image forming apparatus that forms an electrostatic latent image on the surface of the charged electrophotographic photoreceptor, a developing unit that develops the electrostatic latent image formed on the surface of the electrophotographic photoreceptor and forms a toner image, and a transfer unit that transfers the toner image formed on the surface of the electrophotographic photoreceptor to a recording medium. In addition, the image forming apparatus of the exemplary embodiment of the invention may be a so-called tandem type machine having plural photoreceptors in accordance with the toners of various colors, and in this case, it is desirable that all of the photoreceptors be the electrophotographic photoreceptor of the exemplary embodiment. Furthermore, the transfer of the toner image may be carried out by an intermediate transfer system using an intermediate transfer member.

Figure 4:
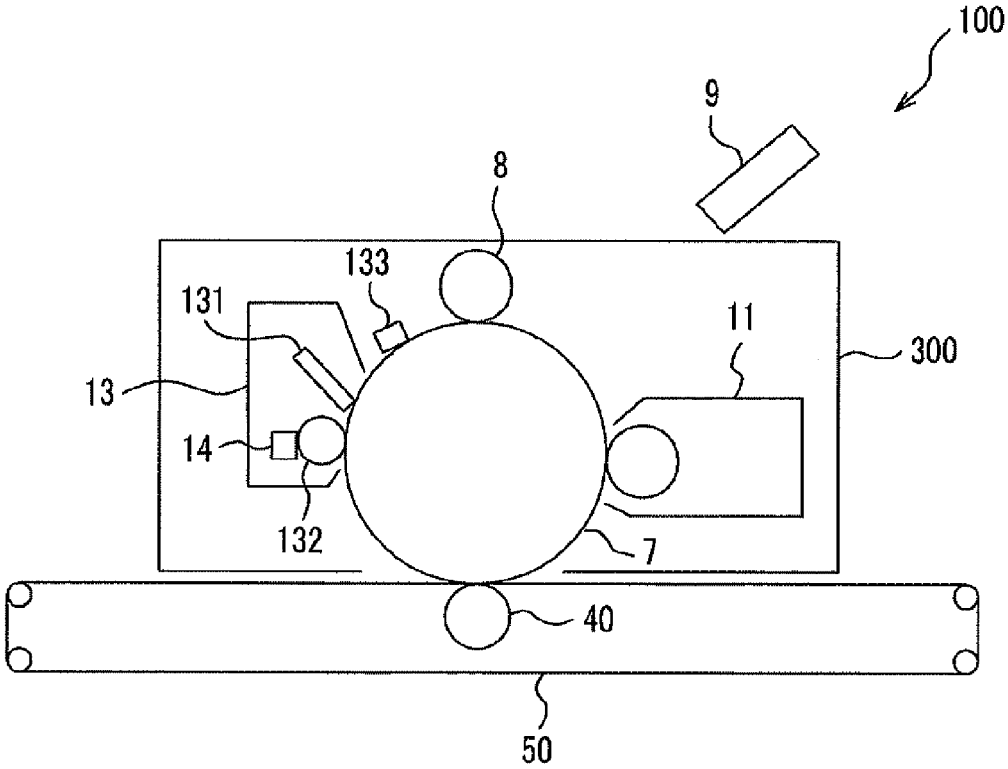
FIG. 4 is a schematic configuration diagram showing an image forming apparatus according to the exemplary embodiment of the invention.

FIG. 4 is a schematic configuration diagram showing the image forming apparatus according to the exemplary embodiment of the invention. The image forming apparatus 100 includes, as shown in FIG. 4, a process cartridge 300 having an electrophotographic photoreceptor 7, an exposure unit 9, a transfer unit 40, and an intermediate transfer member 50. In the image forming apparatus 100, the exposure unit 9 is disposed at a position where the electrophotographic photoreceptor 7 may be exposed through the opening of the process cartridge 300, and the transfer unit 40 is disposed at a position opposite to the electrophotographic photoreceptor 7, with the intermediate transfer member 50 being interposed therebetween. The intermediate transfer member 50 is disposed such that a part thereof is in contact with the electrophotographic photoreceptor 7.

The process cartridge 300 in FIG. 4 supports an electrophotographic photoreceptor 7, a charging unit 8, a developing unit 11 and a cleaning unit 13 altogether in a casing. The cleaning unit 13 has a cleaning blade (cleaning member), and the cleaning blade 131 is disposed to be in contact with the surface of the electrophotographic photoreceptor 7.

Furthermore, there are disclosed examples of using a fibrous member 132 (roller-shaped) that supplies a lubricating material 14 to the surface of the photoreceptor 7, and a fibrous member 133 (flat brush-shaped) that assists cleaning, but these may or may not be used.

As the charging unit 8, for example, a contact type charging device using a conductive or semiconductive charging roller, a charging brush, a charging film, a charging rubber blade, a charging tube or the like is used. Furthermore, known charging devices, such as a non-contact type roller charging device, a scorotron charging device or corotron charging device using corona discharge, are also used.

Although not depicted in the diagram, a photoreceptor heating member for increasing the temperature of the electrophotographic photoreceptor 7 and thereby lowering the relative temperature, may be provided in the periphery of the electrophotographic photoreceptor 7.

The exposure unit 9 may be, for example, an optical instrument which exposes imagewise the surface of the photoreceptor 7 to light such as a semiconductor laser light, an LED light, or a liquid crystal shutter light. For the wavelength of the light source, a wavelength that belongs to the spectral sensitivity region of the photoreceptor is used. The principal range of the wavelength of semiconductor laser light is near-infrared having an emission wavelength at near 780 nm. However, the wavelength of the light source is not limited to this wavelength, and a laser light having an emission wavelength in the region of 600 nm, or a blue laser light having an emission wavelength of from 400 nm to 450 nm may also be used. Furthermore, a surface emission type laser light source that is capable of outputting multiple beams for the formation of multicolor images is also effective.

As the developing unit 11, for example, a general developing unit which performs development in a contact or non-contact manner using a magnetic or non-magnetic single-component developer, a two-component developer, or the like may be used. The developing unit is not particularly limited as long as the unit has the function described above, and is selected according to the purpose. For example, a known developing unit having a function of attaching the single-component developer or the two-component developer to the photoreceptor 7 using a brush, a roller or the like, may be used. Among others, it is desirable to use a developing roller which holds the developer at the surface.

The toner that is used in the developing unit 11 will be described below.

The toner used in the image forming apparatus of the exemplary embodiment of the invention is such that the average shape coefficient $((ML^2/A)\times(\pi/4)\times100$, wherein ML represents the maximum length of a particle, and A represents the projection area of the particle) is desirably from 100 to 150, more desirably from 105 to 145, and even more desirably from 110 to 140. Furthermore, the toner desirably has a volume average particle size of from 3 μm to 12 μm, and more desirably from 3.5 μm to 9 μm.

The toner is not particularly limited in terms of the production method, but use may be made of, for example, toners produced by a kneading pulverization method of adding a binder resin, a colorant and a release agent, as well as other additives such as a charge control agent and the like, and performing kneading, pulverization and classification; a method of modifying the shape of the particles obtained by a kneading pulverization method, by means of mechanical impact force or thermal energy; an emulsion polymerization aggregation method of emulsion polymerizing polymerizable monomers of a binder resin, mixing the dispersion liquid thus formed with a dispersion liquid containing a colorant and a release agent, as well as other additives such as a charge control agent, and subjecting the mixture to aggregation and heat coalescence to obtain toner particles; a suspension polymerization method of suspending polymerizable monomers for obtaining a binder resin, and a solution containing a colorant and a release agent, as well as other additives such as a charge control agent, in an aqueous solvent, and performing polymerization; a dissolution suspension method of suspending a binder resin, and a solution containing a colorant and a release agent, as well as other additives such as a charge control agent, in an aqueous solvent, and granulating the suspension; and the like.

Furthermore, known methods such as a production method of using a toner obtained by the methods described above as the core, further attaching aggregated particles thereto, and thermally coalescing the toner and the particles to give a core-shell structure, are used. As the method for producing a toner, a suspension polymerization method, an emulsion polymerization aggregation method, and a dissolution suspension method, which produce toners in aqueous solvents, are desirable from the viewpoints of controlling the shape and the particle size distribution, and an emulsion polymerization aggregation method is particularly desirable.

The toner mother particles desirably contain binder resin, a colorant and a release agent, and may further contain silica or a charge control agent.

Examples of the binder resin used in the toner mother particles include homopolymers and copolymers of styrenes such as styrene and chlorostyrene; monoolefins such as ethylene, propylene, butylene, and isoprene; vinyl esters such as vinyl acetate, vinyl propionate, vinyl benzoate, and vinyl butyrate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone, and polyester resins obtained by copolymerization of dicarboxylic acids and diols.

Particularly, representative examples of the binder resin include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene, and a polyester resin. Other examples include polyurethane, an epoxy resin, a silicone resin, polyimide, modified rosin, and paraffin wax.

Furthermore, representative examples of the colorant include magnetic components such as magnetite and ferrite; carbon black, aniline blue, calcoil blue, chrome yellow, ultramarine blue, Du Pont oil red, quinoline yellow, methylene blue chloride, phthalocyanine blue, malachite green oxalate, lamp black, Rose Bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, and C.I. Pigment Blue 15:3.

Representative examples of the release agent include low molecular weight polyethylene, low molecular weight polypropylene, Fischer-Tropsch wax, montan wax, carnauba wax, rice wax, and candellila wax.

As the charge control agent, known compounds are used, but azo-based metal complexes, salicylic acid-metal complexes, and resin type charge control agents containing polar groups are used. When the toner is produced by a wet production method, it is desirable to use a material that is not easily dissolved in water. Also, the toner may be any of a magnetic toner including a magnetic material, and a non-magnetic toner that does not contain a magnetic material.

The toner used in the developing unit 11 is produced by mixing the toner mother particles and the external additives in a Henschel mixer, a V-blender or the like. Furthermore, in the case of producing toner mother particles by a wet method, external addition may be carried out in a wet manner.

Active particles may be added to the toner used in the developing unit 11. Examples of the active particles that may be used include particles of solid lubricants such as graphite, molybdenum disulfide, talc, fatty acids, and fatty acid metal salts; low molecular weight polyolefins such as polypropylene, polyethylene, and polybutene; silicones having softening points by heating; aliphatic amides such as oleic acid amide, erucic acid amide, ricinolic acid amide, and stearic acid amide; plant waxes such as carnauba wax, rice wax, candellila wax, wood wax, and jojoba oil; animal waxes such as beeswax; mineral and petroleum waxes such as montan wax, ozokerite, ceresin, paraffin wax, microcrystalline wax, and Fischer-Tropsch wax; and modification products thereof. These may be used individually, or two or more kinds may be used in combination. However, the average particle size is desirably in the range of from 0.1 μm to 10 μm, and products having the chemical structures described above may be pulverized to provide this particle size. The amount of the toner added is preferably in the range of from 0.05% by mass to 2.0% by mass, and more desirably from 0.1% by mass to 1.5% by mass.

The toner used in the developing unit 11 may further contain inorganic particles, organic particles, complex particles in which inorganic particles are attached to organic particles, and the like.

Examples of the inorganic particles that may be suitably used include particles of various inorganic oxides, nitrides and borides such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride.

Furthermore, the inorganic particles may be treated with titanium coupling agents such as tetrabutyl titanate, tetraoctyl titanate, isopropyltriisostearoyl titanate, isopropyltridecylbenzenesulfonyl titanate, and bis(dioctylpyrophosphate)oxyacetate titanate; and silane coupling agents such as γ-(2-aminoethyl)aminopropyltrimethoxysilane, γ-(2-aminoethyl) aminopropylmethyldimethoxysilane, γ-methacryloxypropyltrimethoxysilane, N-β-(N-vinylbenzylaminoethyl)-γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, and p-methylphenyltrimethoxysilane. Furthermore, inorganic particles being subjected to a hydrophobization treatment using silicone oil or higher fatty acid metal salts such as aluminum stearate, zinc stearate, and calcium stearate, are also favorably used.

Examples of the organic particles include styrene resin particles, styrene-acrylic resin particles, polyester resin particles, and urethane resin particles.

In regard to the particle size, particles having a number average particle size of desirably from 5 nm to 1000 nm, more desirably from 5 nm to 800 nm, and even more desirably from 5 nm to 700 nm, are used. Also, it is desirable that the sum of the added amounts of the particles described above and the active particles is 0.6% by mass or greater.

As the other inorganic oxides that are added to the toner, small-sized inorganic oxide particles having a primary particle size of 40 nm or less are used, and it is more desirable to use inorganic oxide particles having larger diameters. Any known compound may be used as these inorganic oxide particles, but it is desirable to use silica and titanium oxide in combination.

The small-sized inorganic particles may also be surface treated. It is also desirable to add carbonates such as calcium carbonate and magnesium carbonate, or inorganic minerals such as hydrotalcite.

The color toner for electrophotography is used as a mixture with a carrier, and examples of the carrier that may be used include powdered iron, glass beads, powdered ferrite, powdered nickel, and products obtained by coating the surfaces of the aforementioned powders and beads with a resin. The mixing ratio of the color toner and the carrier may be defined according to necessity.

Examples of the transfer unit 40 include known transfer charging devices, such as contact type transfer charging devices using a belt, a roller, a film, a rubber blade and the like; and scorotron transfer charging devices or corotron transfer charging devices using corona discharge.

Examples of the intermediate transfer member 50 that may be used include belt-shaped transfer bodies (intermediate transfer belts) made of polyimide, polyamideimide, polycarbonate, polyallylate, polyester, rubber and the like, which are imparted with semiconductivity. Furthermore, in regard to the shape of the intermediate transfer member 50, a transfer member having a drum shape may be used in addition to the belt-shaped transfer member.

The image forming apparatus 100 may include, in addition to the various units described above, for example, a photo-erasing device which performs photo-erase for the photoreceptor 7.

Figure 5:
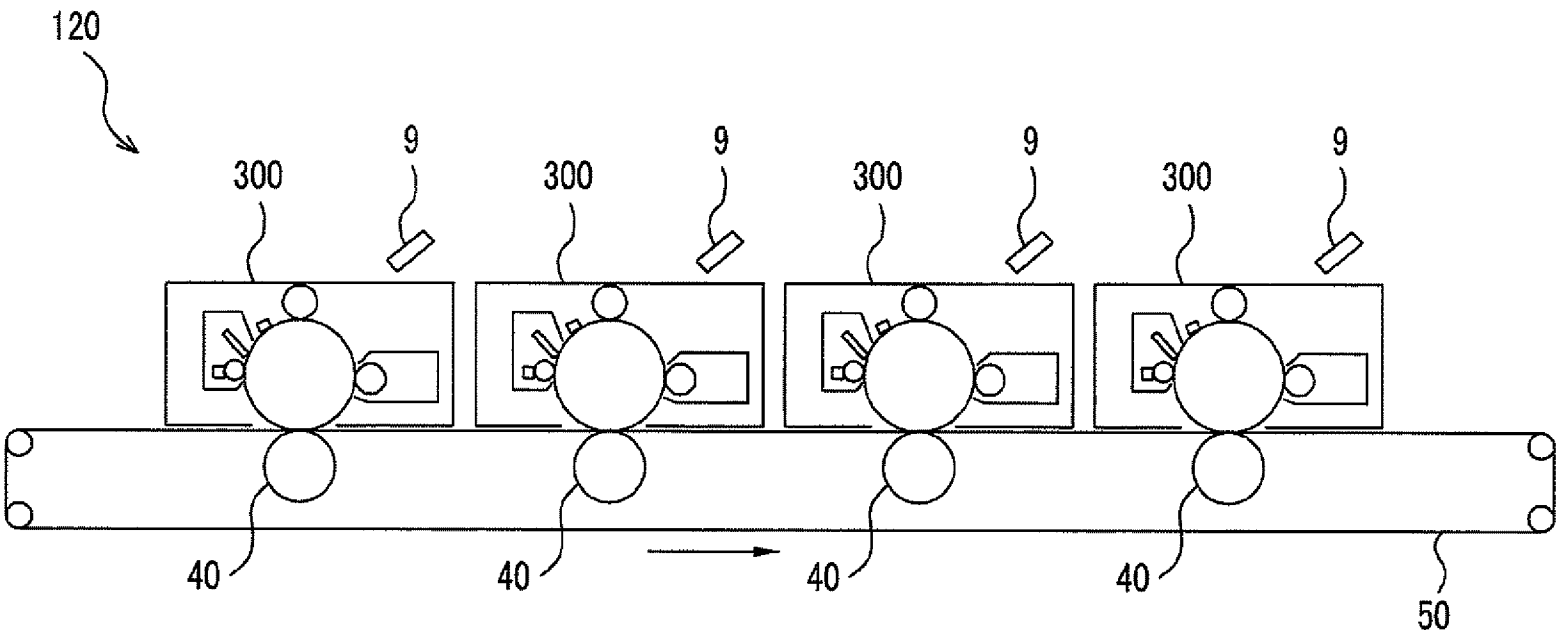
FIG. 5 is a schematic configuration diagram showing an image forming apparatus according to the exemplary embodiment of the invention.

FIG. 5 is a schematic cross-sectional view showing an image forming apparatus according to another exemplary embodiment. The image forming apparatus 120 is a tandem type multicolor image forming apparatus equipped with four process cartridges 300, as show in FIG. 5. The image forming apparatus 120 has a configuration in which four process cartridges 300 are disposed in parallel on an intermediate transfer member 50, and one electrophotographic photoreceptor is used per color. Furthermore, the image forming apparatus 120 has the same configuration as the image forming apparatus 100, except for being a tandem system.

Furthermore, in the image forming apparatus (process cartridge) according to the exemplary embodiment of the invention, the developing unit may have a developing roller which is a developer holding member moving (rotating) in the reverse direction of the direction of movement (direction of rotation) of the electrophotographic photoreceptor. Here, the developing roller has a cylindrically shaped developing sleeve that retains a developer on the surface, and the developing unit may have a configuration including a regulating member which regulates the amount of the developer supplied to this developing sleeve. When the developing roller of the developing unit is moved (rotated) in the reverse direction of the direction of rotation of the electrophotographic photoreceptor, the toner that is present at the position interposed between the developing roller and the electrophotographic photoreceptor is brought into contact with the surface of the electrophotographic photoreceptor.

In the image forming apparatus of the exemplary embodiment of the invention, it is desirable to adjust the distance between the developing sleeve and the photoreceptor to a value from 200 μm to 600 μm, and more desirably from 300 mm to 500 μm. Furthermore, it is desirable to adjust the distance between the developing sleeve and the regulating blade, which is a regulating member that regulates the amount of developer, to a value of from 300 μm to 1000 μm, and more desirably from 400 μm to 750 μm.

Furthermore, it is desirable to adjust the absolute value of the velocity of movement of the developing roller surface to a value of from 1.5 times to 2.5 times, more desirably from 1.7 times to 2.0 times, the absolute value of the velocity of movement of the photoreceptor surface (process speed).

In the image forming apparatus (process cartridge) according to the exemplary embodiment of the invention, the developing unit is desirably an unit which includes a developer holding member having a magnetic material, and develops an electrostatic latent image with a two-component developer containing a magnetic carrier and a toner.

EXAMPLES

Hereinafter, the invention will be described more specifically based on Examples and Comparative Examples, but the invention is not intended to be limited to the following Examples.

Example A

[Photoreceptor 1]

(Formation of Undercoat Layer)

100 parts by mass of zinc oxide (average particle size: 70 nm, manufactured by Tayca Corp.: specific surface area 15 $m^2/g$) is mixed under stirring with 500 parts by mass of toluene, and 1.25 parts by mass of KBM603 (manufactured by Shin-Etsu Chemical Co., Ltd.) as a silane coupling agent is added to the mixture. The mixture is stirred for 2 hours. Subsequently, toluene is distilled off under reduced pressure, and the residue is baked for 3 hours at 120° C. Thus, silane coupling agent-surface treated zinc oxide particles are obtained.

100 parts by mass of the surface treated zinc oxide particles are added to 500 parts by mass of tetrahydrofuran, and the mixture is mixed under stirring. A solution prepared by dissolving 1 part by mass of alizarin in 50 parts by mass of tetrahydrofuran is added to the mixture, and the mixture is stirred for 5 hours at 50° C. Subsequently, the zinc oxide particles combined with alizarin are separated by filtration under reduced pressure, and are dried under reduced pressure at 60° C. Thus, alizarin-applied zinc oxide particles are obtained.

A solution is prepared by dissolving 60 parts by mass of the alizarin-applied zinc oxide particles thus obtained, 13.5 parts by mass of a blocked isocyanate (SUMIJUR 3173, manufactured by Sumitomo Bayer Urethane Co., Ltd.) as a curing agent, and 15 parts by mass of a butyral resin (BM-1, manufactured by Sekisui Chemical Co., Ltd.) in 85 parts by mass of methyl ethyl ketone. 38 parts by mass of the solution thus obtained and 25 parts by mass of methyl ethyl ketone are mixed, and the mixture is dispersed for 2 hours in a sand mill using glass beads having a diameter of 1 mm. Thus, a dispersion liquid is obtained.

0.005 part by mass of dioctyltin dilaurate as a catalyst and 40 parts by mass of silicone resin particles (TOSPEARL 145, manufactured by GE Toshiba Silicones Co., Ltd.) are added to the dispersion liquid thus obtained and the liquid is dried and cured at 170° C. for 40 minutes, and a coating liquid for undercoat layer is obtained. This coating liquid is applied on an aluminum base material having a diameter of 60 mm, a length of 357 mm and a thickness of 1 mm by a dip coating method. Thus, an undercoat layer having a thickness of 20 μm is obtained.

(Formation of Charge Generating Layer)

A mixture of 1 part by mass of chlorogallium phthalocyanine crystals having strong diffraction peaks at Bragg's angles (2θ±0.2°) of at least 7.4°, 16.6°, 25.5°, and 28.3° in the X-ray diffraction spectrum obtained using CuKα characteristic X-rays as a charge generating material, and 1 part by mass of a polyvinyl butyral resin (trade name: S-LEC BM-S, manufactured by Sekisui Chemical Co., Ltd.) are added to 100 parts by mass of butyl acetate, and the mixture is dispersed by treating the mixture for one hour with a paint shaker together with glass beads. Subsequently, the coating liquid thus obtained is applied by dip coating on the surface of the undercoat layer, and the coating liquid is dried by heating at 100° C. for 10 minutes. Thus, a charge generating layer having a thickness of 0.2 μm is formed.

(Formation of Charge Transport Layer)

Furthermore, 2.1 parts by mass of a compound 1 represented by the following formula and 2.9 parts by mass of a polymer compound represented by the following structural formula 1 (viscosity average molecular weight: 39,000) are dissolved in 10 parts by mass of tetrahydrofuran and 5 parts by mass of toluene, and thus a coating liquid is prepared. The coating liquid thus obtained is applied by dip coating on the surface of the charge generating layer, and the coating liquid is dried by heating at 135° C. for 35 minutes. Thus, a charge transport layer having a thickness of 24 μm is formed.

Compound 1

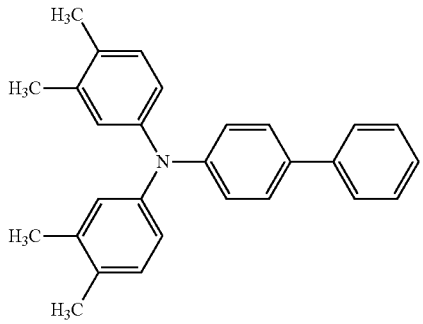

Structural Formula 1

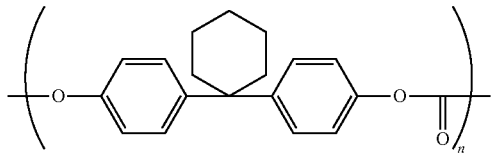

(Formation of Protective Layer)

10 parts of LUBRON L-2 (manufactured by Daikin Industries, Ltd., average primary particle size: 0.2 μm) as tetrafluoroethylene resin particles, and 0.5 part of a fluoroalkyl group-containing copolymer containing a repeating unit represented by the following structural formula 2 (weight average molecular weight 50,000, l:m=1:1, s=1, n=60) are added to 40 parts of cyclopentanone, and the mixture is mixed under stirring. Subsequently, the pressure of the mixture is increased to 700 kgf/cm$^2$ using a high pressure homogenizer (YSNM-1500AR, manufactured by Yoshida Kikai Co., Ltd.) equipped with a penetration type chamber having fine flow channels, and a dispersion process is repeated five times. Thus, a tetrafluoroethylene resin particle suspension liquid (A) is prepared.

Structural Formula 2

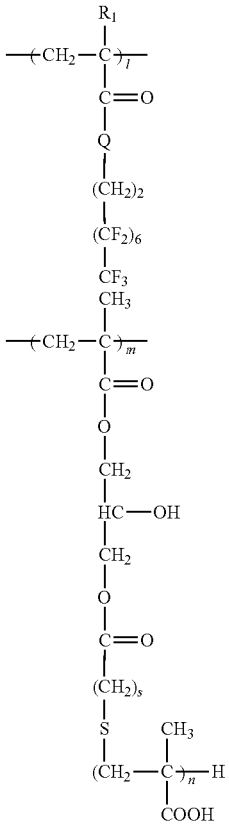

Subsequently, 52 parts of a compound represented by formula (I-8), 43 parts of a compound represented by formula (I-26), 4 parts of a benzoguanamine resin (NIKALAC BL-60, manufactured by Sanwa Chemical Co., Ltd.), 1 part of dimethylpolysiloxane (GLANOL 450, manufactured by Kyoeisha Chemical Co., Ltd.), and 0.1 part of NACURE 5225 (manufactured by King Industries, Inc.) are dissolved in 150 parts of cyclopentanone, and the solution is stirred for 6 hours at 40° C. Thus, a curable film liquid (B) is prepared.

Furthermore, 110 parts by mass of the tetrafluoroethylene resin particle suspension liquid (A) and 100 parts by mass of the curable film liquid (B) are mixed, and thus a coating liquid for protective layer is prepared.

The coating liquid for protective layer thus obtained is applied on the charge transport layer by an inkjet coating method, and is dried at 155° C. for 35 minutes. Thus, a photoreceptor on which a protective layer having a thickness of 6 μm is formed, is obtained, and this is designated as photoreceptor 1.

[Photoreceptor 2]

A photoreceptor is produced in the same manner as in the case of the photoreceptor 1, except that the curable film liquid (B) is prepared using 72 parts of the compound represented by the formula (I-8) and 23 parts of the compound represented by the formula (I-26), for the formation of the protective layer of the photoreceptor 1. This photoreceptor is designated as photoreceptor 2.

[Photoreceptor 3]

A photoreceptor is produced in the same manner as in the case of the photoreceptor 1, except that the solvent used in the preparation of the tetrafluoroethylene resin particle suspension liquid (A) and the solvent used in the preparation of the curable film liquid (B) are replaced with a mixed solvent of cyclopentanone and cyclopentanol at 7:3, for the formation of the protective layer of the photoreceptor 1. This photoreceptor is designated as photoreceptor 3.

[Photoreceptor 4]

A photoreceptor is produced in the same manner as in the case of the photoreceptor 3, except that the amount of the fluoroalkyl group-containing copolymer containing the repeating unit represented by the structural formula 2, which is used in the preparation of the tetrafluoroethylene resin particle suspension liquid (A), is changed to 0.25 part, for the formation of the protective layer of the photoreceptor 3. This photoreceptor is designated as photoreceptor 4.

[Photoreceptor 5]

A photoreceptor is produced in the same manner as in the case of the photoreceptor 1, except that the solvent used in the preparation of the tetrafluoroethylene resin particle suspension liquid (A) and the solvent used in the preparation of the curable film liquid (B) are replaced with a mixed solvent of cyclopentanone and cyclopentanol at 5:5, for the formation of the protective layer of the photoreceptor 1. This photoreceptor is designated as photoreceptor 5.

[Photoreceptor 6]

A photoreceptor is produced in the same manner as in the case of the photoreceptor 1, except that the solvent used in the preparation of the tetrafluoroethylene resin particle suspension liquid (A) and the solvent used in the preparation of the curable film liquid (B) are replaced with a mixed solvent of cyclopentanone and cyclopentanol at 2:8, for the formation of the protective layer of the photoreceptor 1. This photoreceptor is designated as photoreceptor 6.

[Photoreceptor 7]

A photoreceptor is produced in the same manner as in the case of the photoreceptor 1, except that the coating liquid for protective layer is prepared by mixing 250 parts by mass of the tetrafluoroethylene resin particle suspension liquid (A) and 100 parts by mass of the curable film liquid (B), for the formation of the protective layer of the photoreceptor 1. This photoreceptor is designated as photoreceptor 7.

[Photoreceptor 8]

A photoreceptor is produced in the same manner as in the case of the photoreceptor 7, except that the curable film liquid (B) is prepared by using 28 parts of the compound represented by the formula (I-8) and 67 parts of the compound represented by the formula (I-26), for the formation of the protective layer of the photoreceptor 7. This photoreceptor is designated as photoreceptor 8.

[Photoreceptor 9]

A photoreceptor is produced in the same manner as in the case of the photoreceptor 1, except that the amount of cyclopentanone used in the preparation of the tetrafluoroethylene resin particle suspension liquid (A) is changed to 20 parts by mass, and the coating liquid for protective layer is prepared by mixing 380 parts by mass of the tetrafluoroethylene resin particle suspension liquid (A) and 100 parts by mass of the curable film liquid (B), for the formation of the protective layer of the photoreceptor 1. This photoreceptor is designated as photoreceptor 9.

[Photoreceptor 10]

A photoreceptor is produced in the same manner as in the case of the photoreceptor 1, except that the curable film liquid (B) is prepared by using 95 parts of the compound represented by the formula (I-8), but without using the compound represented by the formula (I-26), for the formation of the protective layer of the photoreceptor 1. This photoreceptor is designated as photoreceptor 10.

[Photoreceptor 11]

A photoreceptor is produced in the same manner as in the case of the photoreceptor 2, except that the solvent used in the preparation of the tetrafluoroethylene resin particle suspension liquid (A) and the solvent used in the preparation of the curable film liquid (B) are changed to cyclopentyl methyl ether, for the formation of the protective layer of the photoreceptor 2. This photoreceptor is designated as photoreceptor 11.

[Photoreceptor 12]

A photoreceptor is produced in the same manner as in the case of the photoreceptor 1, except that FLUON L173JE (manufactured by Asahi Glass Co., Ltd., average primary particle size: 0.25 μm) is used as the tetrafluoroethylene resin particles, for the formation of the protective layer of the photoreceptor 1. This photoreceptor is designated as photoreceptor 12.

[Photoreceptor 13]

A photoreceptor is produced in the same manner as in the case of the photoreceptor 1, except that a compound represented by formula (I-16) is used instead of the compound represented by the formula (I-8), for the formation of the protective layer of the photoreceptor 1. This photoreceptor is designated as photoreceptor 13.

[Photoreceptor 14]

A photoreceptor is produced in the same manner as in the case of the photoreceptor 1, except that the thickness of the protective layer is changed to 4 μm for the formation of the protective layer of the photoreceptor 1. This photoreceptor is designated as photoreceptor 14.

[Photoreceptor 15]

A photoreceptor is produced in the same manner as in the case of the photoreceptor 1, except that the thickness of the protective layer is changed to 10 μm for the formation of the protective layer of the photoreceptor 1. This photoreceptor is designated as photoreceptor 15.

[Evaluation of Photoreceptor]

For the photoreceptors thus obtained, the values of $A_1$, $A_2$ and $A_3$ in relation to the cross-section of the protective layer are determined by the method described above. The results are shown in Table 1.

An image forming test is carried out using the photoreceptors thus obtained. Specifically, DocuCentre-II C7500 manufactured by Fuji Xerox Co., Ltd. is used as the testing machine, and this machine is modified before use so as to form images at a rate of 150 sheets/min. Images are formed in the black-and-white mode, and images having an image density of 5% are formed on A4-sized paper in a high temperature high humidity (28° C., 80% RH) environment at a rate of 150 sheets/min.

In regard to the evaluation of the initial cleaning properties and the post-use cleaning properties, the image of the $500^{th}$ sheet (initial) and the image at a time point when the residual thickness of the protective layer reached 1.5 μm (post-use) are evaluated by measuring the difference between the maximum value and the minimum value of the reflection density (ΔD) in a full-area halftone image with a writing density of 50%. The evaluation criteria are as follows, and the results are shown in Table 1.

G1: Less than 0.01

G2: Equal to or greater than 0.01 and less than 0.02

G3: Equal to or greater than 0.02 and less than 0.03

G4: Equal to or greater than 0.03

Furthermore, the photoreceptors are taken out at a time point when the residual thickness reached 1.5 μm during the image formation, and whether peeling of the protective layer occurred is evaluated by visual inspection and by observation with a laser microscope. Thus, the photoreceptors are evaluated by the number of sites where peeling occurs. The evaluation criteria are as follows, and the results are shown in Table 1.

G1: None

G2: Fewer than two sites

G3: Two or more sites

TABLE 1

| | Photo-receptor | $A_1$ | $A_2$ | $A_3$ | $A_1/A_2$ | $A_2/A_3$ | Initial cleaning properties | Post-use cleaning properties | Peeling |
|---|---|---|---|---|---|---|---|---|---|
| Example 1 | 1 | 0.04 | 4.05 | 5.4 | 0.01 | 0.75 | G1 | G1 | G1 |
| Example 2 | 2 | 0.5 | 5.6 | 5.4 | 0.09 | 1.04 | G1 | G1 | G1 |
| Example 3 | 3 | 1.9 | 5.0 | 5.4 | 0.38 | 0.93 | G1 | G1 | G1 |
| Example 4 | 4 | 3.1 | 6.4 | 5.4 | 0.48 | 1.19 | G1 | G2 | G2 |
| Example 5 | 7 | 3.5 | 8.8 | 11 | 0.40 | 0.80 | G1 | G2 | G2 |
| Example 6 | 9 | 7.0 | 15.5 | 15.3 | 0.45 | 1.01 | G1 | G2 | G2 |
| Example 7 | 12 | 0.04 | 4.2 | 5.4 | 0.01 | 0.78 | G1 | G1 | G1 |
| Example 8 | 13 | 0.03 | 5.8 | 5.4 | 0.01 | 1.07 | G1 | G1 | G1 |
| Example 9 | 14 | 0.40 | 5.7 | 5.4 | 0.07 | 1.06 | G1 | G2 | G2 |
| Example 10 | 15 | 0.04 | 5.3 | 5.4 | 0.01 | 0.98 | G1 | G1 | G1 |
| Comp. Ex. 1 | 5 | 2.9 | 5.6 | 5.4 | 0.52 | 1.04 | G1 | G3 | G3 |
| Comp. Ex. 2 | 6 | 5.3 | 5.5 | 5.4 | 0.96 | 1.02 | G2 | G4 | G3 |
| Comp. Ex. 3 | 10 | 5.2 | 5.5 | 5.4 | 0.95 | 1.02 | G1 | G4 | G3 |
| Comp. Ex. 4 | 11 | 0.03 | 6.6 | 5.4 | 0.00 | 1.22 | G3 | G4 | G3 |
| Comp. Ex. 5 | 8 | 1.7 | 7.6 | 11.2 | 0.22 | 0.68 | G1 | G3 | G3 |

From the results shown above, it may be seen that the electrophotographic photoreceptors obtained in the Examples have satisfactory initial cleaning properties and post-use cleaning properties, do not easily peel off, and maintain the removability of toner on the surface, as compared with the electrophotographic photoreceptors of the Comparative Examples, so that images with satisfactory image quality are formed for a long time period.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a substrate;

a photosensitive layer provided on the substrate; and a surface layer that is a single layer provided on the photosensitive layer to be in contact with the photosensitive layer, contains fluororesin particles, and has a thickness of 4 μm or greater, in which the cross-section obtained by cutting the surface layer along the thickness direction satisfies the following formula (1) and the following formula (2):

$$0 \leqq A_1 \leqq 0.5 \times A_2 \quad \text{Formula (1):}$$

$$0.7 \times A_3 \leqq A_2 \leqq 1.2 \times A_3 \quad \text{Formula (2):}$$

wherein in the formula (1) and the formula (2), $A_1$ represents the proportion (%) of the area of the fluororesin particles occupying a region designated as a first region, which lies in the cross-section at a distance from the interface between the photosensitive layer and the surface layer, of from 0 μm to 0.5 μm; $A_2$ represents the proportion (%) of the area of the fluororesin particles occupying a region designated as a second region, which lies in the cross-section at a distance from the interface between the photosensitive layer and the surface layer, of from 1 μm to 3 μm; and $A_3$ represents the proportion (%) of the area of the fluororesin particles occupying the entire cross-section with respect to the entire area of the cross-section.

2. The electrophotographic photoreceptor of claim 1, wherein the thickness of the surface layer is about 15 μm or less.

3. The electrophotographic photoreceptor of claim 1, wherein the average primary particle size of the fluororesin particles is from about 0.05 μm to about 1 μm.

4. The electrophotographic photoreceptor of claim 1, wherein the content of the fluororesin particles is from about 1% by mass to about 30% by mass based on the surface layer.

5. The electrophotographic photoreceptor of claim 1, wherein the surface layer contains the cross-linked product of a mixture containing a cross-linkable compound having an alkoxy group and a cross-linkable compound having a hydroxyl group.

6. The electrophotographic photoreceptor of claim 5, wherein the content of a component derived from the cross-linkable compound having an alkoxy group in the cross-linked product is in the range of from 0.1 time to 3.0 times the content of a component derived from the cross-linkable compound having a hydroxyl group.

7. The electrophotographic photoreceptor of claim 1, wherein the value of $A_1$ is 0.3 time or less the value of $A_2$, and the value of $A_2$ is from 0.9 time to 1.1 times the value of $A_3$.

8. The electrophotographic photoreceptor of claim 1, wherein the surface layer is a single layer having a thickness of 8 μm or greater, and the cross-section of the surface layer satisfies the following formula (3):

$$0.7 \times A_3 \leqq A_4 \leqq 1.2 \times A_3 \quad \text{Formula (3):}$$

wherein in the formula (3), $A_4$ represents the proportion (%) of the area of the fluororesin particles occupying a region designated as a third region, which lies in the cross-section of the surface layer at a distance of 4 μm or greater from the interface with the photosensitive layer.

9. An image forming apparatus comprising:

the electrophotographic photoreceptor of claim 1;

a charging unit that charges the surface of the electrophotographic photoreceptor;

a latent image forming unit that forms an electrostatic latent image on the surface of the charged electrophotographic photoreceptor;

a developing unit that develops the electrostatic latent image formed on the surface of the electrophotographic photoreceptor with a toner and thereby forms a toner image; and a transfer unit that transfers the toner image formed on the surface of the electrophotographic photoreceptor onto a recording medium.

10. The image forming apparatus of claim 9, wherein the surface layer of the electrophotographic photoreceptor contains the cross-linked product of a mixture containing a cross-linkable compound having an alkoxy group and a cross-linkable compound having a hydroxyl group.

11. The image forming apparatus of claim 9, wherein the average primary particle size of the fluororesin particles of the electrophotographic photoreceptor is from about 0.05 μm to about 1 μm.

12. The image forming apparatus of claim 9, wherein the content of the component derived from the cross-linkable compound having an alkoxy group in the cross-linked product of the electrophotographic photoreceptor is in the range of from 0.1 time to 3.0 times the content of the component derived from the cross-linkable compound having a hydroxyl group.

13. The image forming apparatus of claim 9, wherein in the electrophotographic photoreceptor the value of $A_1$ is 0.3 time or less the value of $A_2$, and the value of $A_2$ is from 0.9 time to 1.1 times the value of $A_3$.

14. A process cartridge comprising:

the electrophotographic photoreceptor of claim 1; and at least one selected from the group consisting of a charging unit that charges the surface of the electrophotographic photoreceptor, a latent image forming unit that forms an electrostatic latent image on the surface of the charged electrophotographic photoreceptor, a developing unit that develops the electrostatic latent image formed on the surface of the electrophotographic photoreceptor with a toner and thereby forms a toner image, a transfer unit that transfers the toner image formed on the surface of the electrophotographic photoreceptor onto a recording medium, and a cleaning unit that cleans the electrophotographic photoreceptor.

15. The process cartridge of claim 14, wherein the surface layer of the electrophotographic photoreceptor contains the cross-linked product of a mixture containing a cross-linkable compound having an alkoxy group and a cross-linkable compound having a hydroxyl group.

16. The process cartridge of claim 14, wherein the layer constituting the outermost surface of the photoreceptor is formed by performing polymerization using the cross-linkable charge transporting material having a reactive hydroxyl group and the cross-linkable charge transporting material having a reactive alkoxy group in an amount of 90% by mass or more based on the total amount of monomers.

17. The process cartridge of claim 14, wherein in the electrophotographic photoreceptor the value of $A_1$ is 0.3 time or less the value of $A_2$, and the value of $A_2$ is from 0.9 time to 1.1 times the value of $A_3$.

* * * * *